US010520848B2

(12) United States Patent
Ishida et al.

(10) Patent No.: US 10,520,848 B2
(45) Date of Patent: Dec. 31, 2019

(54) IMAGE FORMING APPARATUS WITH VARIABLE LIGHT EMISSION AMOUNTS

(71) Applicant: CANON KABUSHIKI KAISHA, Tokyo (JP)

(72) Inventors: Satoshi Ishida, Fujisawa (JP); Takeshi Shimba, Kawasaki (JP); Tatsuya Hotogi, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/200,962

(22) Filed: Nov. 27, 2018

(65) Prior Publication Data

US 2019/0163087 A1 May 30, 2019

(30) Foreign Application Priority Data

Nov. 28, 2017 (JP) ..... 2017-227859
Nov. 28, 2017 (JP) ..... 2017-227967

(51) Int. Cl.
*G03G 15/04* (2006.01)
*G03G 15/043* (2006.01)

(52) U.S. Cl.
CPC ..... *G03G 15/043* (2013.01)

(58) Field of Classification Search
CPC ..... G03G 15/043
See application file for complete search history.

(56) References Cited

U.S. PATENT DOCUMENTS 8,982,168 B2 3/2015 Maeda et al.
9,041,757 B2 5/2015 Hayakawa et al.
9,250,557 B2 2/2016 Shiomichi
9,304,430 B2 4/2016 Matsumoto et al.
9,632,449 B2 4/2017 Maeda
9,632,450 B2 4/2017 Shiomichi
2006/0033804 A1* 2/2006 Dan ..... G02B 26/121 347/230
2012/0147119 A1* 6/2012 Toyoizumi ..... G03G 15/043 347/224
2014/0169816 A1* 6/2014 Hashii ..... G03G 15/043 399/51

(Continued)

FOREIGN PATENT DOCUMENTS

JP 2002-067377 A 3/2002
JP 2010-044205 A 2/2010
JP 2013-195975 A 9/2013

(Continued)

*Primary Examiner* — Sophia S Chen
(74) *Attorney, Agent, or Firm* — Venable LLP

(57) ABSTRACT

When a photosensitive member and a developing portion are in a separation state and in a start-up period, a first light emission is performed in an image region and a non-image region. When light is detected at least twice during a period when the first light emission is being performed, a second light emission is performed in the non-image region. When a prescribed period of time has elapsed from the start of the second light emission, a third light emission is performed in the image region in a third light emission amount that is smaller than a second light emission amount during a period in which the photosensitive member makes at least one revolution. After the third light emission is performed, the photosensitive member and the developing portion are switched to a contact state.

20 Claims, 21 Drawing Sheets

(56) References Cited

U.S. PATENT DOCUMENTS

2017/0363862 A1* 12/2017 Hotogi ..... B41J 2/442

FOREIGN PATENT DOCUMENTS

| | | | |
|---|---|---|---|
| JP | 2013-254173 | A | 12/2013 |
| JP | 2014-013373 | A | 1/2014 |
| JP | 2014-228657 | A | 12/2014 |
| JP | 2015-001629 | A | 1/2015 |
| JP | 2016-112686 | A | 6/2016 |

* cited by examiner

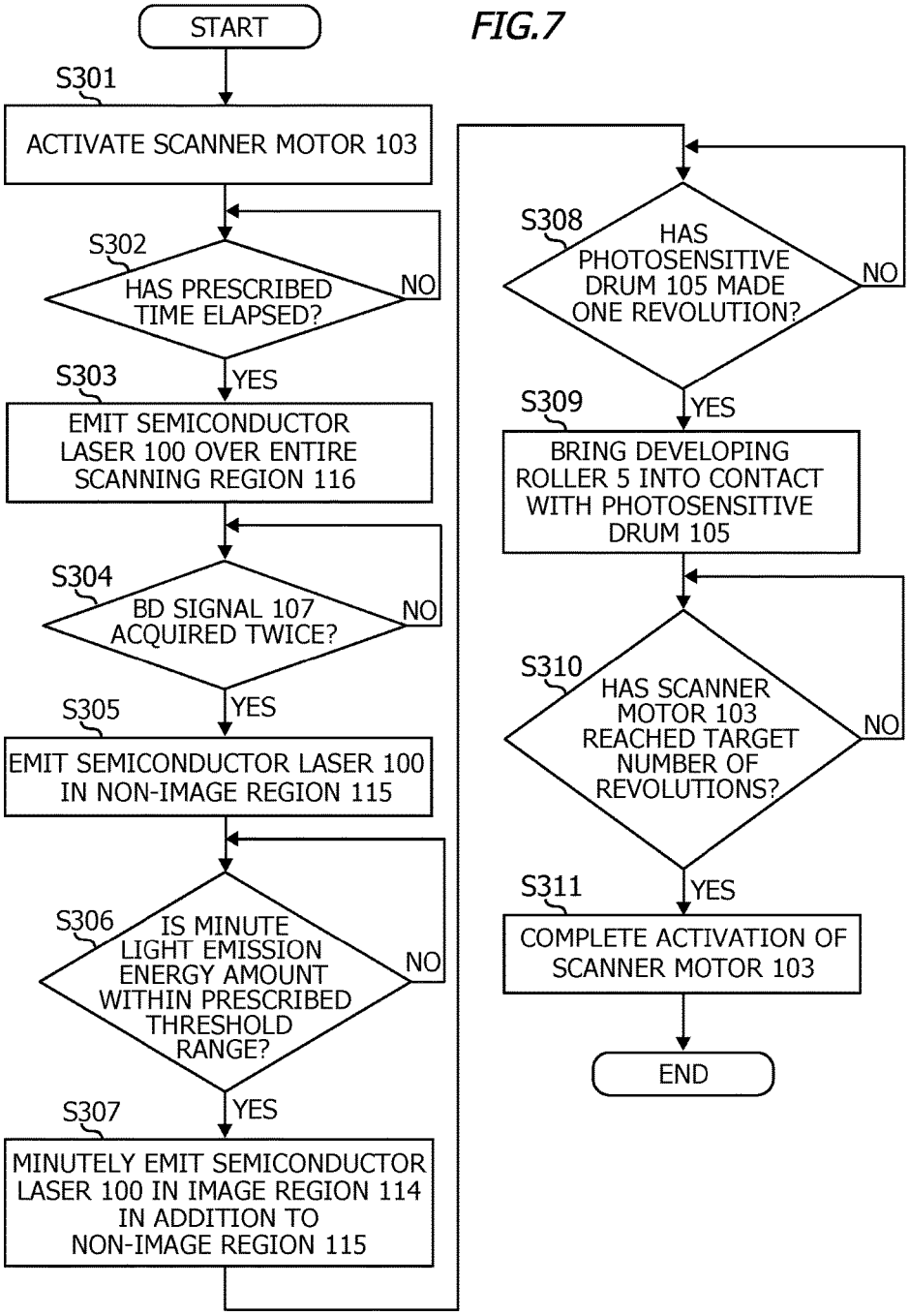
FIG.7
START
S301
ACTIVATE SCANNER MOTOR 103
S302
HAS PRESCRIBED TIME ELAPSED?
NO
YES
S303
EMIT SEMICONDUCTOR LASER 100 OVER ENTIRE SCANNING REGION 116
S304
BD SIGNAL 107 ACQUIRED TWICE?
NO
YES
S305
EMIT SEMICONDUCTOR LASER 100 IN NON-IMAGE REGION 115
S306
IS MINUTE LIGHT EMISSION ENERGY AMOUNT WITHIN PRESCRIBED THRESHOLD RANGE?
NO
YES
S307
MINUTELY EMIT SEMICONDUCTOR LASER 100 IN IMAGE REGION 114 IN ADDITION TO NON-IMAGE REGION 115
S308
HAS PHOTOSENSITIVE DRUM 105 MADE ONE REVOLUTION?
NO
YES
S309
BRING DEVELOPING ROLLER 5 INTO CONTACT WITH PHOTOSENSITIVE DRUM 105
S310
HAS SCANNER MOTOR 103 REACHED TARGET NUMBER OF REVOLUTIONS?
NO
YES
S311
COMPLETE ACTIVATION OF SCANNER MOTOR 103
END

INITIAL STAGE

CUMULATIVE ROTATING TIME = APPROXIMATELY 100,000 SECONDS

CUMULATIVE ROTATING TIME = APPROXIMATELY 100,000 SECONDS

SCANNER SCANNING SPEED: Vx
SECOND LIGHT EMISSION LEVEL: Wbg

SCANNER SCANNING SPEED: Vx/2
SECOND LIGHT EMISSION LEVEL: Wbg

SCANNER SCANNING SPEED: Vx/2
SECOND LIGHT EMISSION LEVEL: Wbg/2

IMAGE FORMING APPARATUS WITH VARIABLE LIGHT EMISSION AMOUNTS

BACKGROUND OF THE INVENTION

Field of the Invention

The present invention relates to activation control of a scanning apparatus used in an image forming apparatus such as an electrophotographic printer which performs exposure using laser light.

Description of the Related Art

Conventionally, in image forming apparatuses using an electrophotographic system, the following electrophotographic process is executed. First, a surface of a photosensitive drum is uniformly charged by charging means. In addition, laser scanning is performed by a scanning apparatus and an electrostatic latent image is formed on the photosensitive drum. The formed electrostatic latent image is developed as a toner image by developing means. By transferring the developed toner image to a transferred body and fixing the transferred toner image, image formation is performed.

In such an image forming apparatus, surface potential of the photosensitive drum is preferably controlled when forming an electrostatic latent image on the surface of the photosensitive drum. Japanese Patent Application Laid-open No. 2014-13373 discloses control for minutely emitting a laser beam to a non-image portion in an entire printable area of a photosensitive drum charged at a prescribed charging potential in order to control surface potential of the photosensitive drum.

SUMMARY OF THE INVENTION

As described in conventional art, the surface potential of a photosensitive drum can be appropriately controlled by minutely emitting a laser beam. However, exposing a photosensitive drum with a laser beam advances deterioration of the photosensitive drum to no small degree. In particular, in a start-up period of a scanning apparatus (a rotating mirror or a rotating polygon mirror), the rotating polygon mirror is being accelerated so as to attain a prescribed speed. In such a state, unless a minute light emission amount of a laser beam is appropriately controlled in accordance with a rotational speed of the rotating polygon mirror, there is a possibility that the surface potential of the photosensitive drum is not able to be appropriately controlled. In addition, in such a state where the speed of the rotating polygon mirror is slower than the prescribed speed, since an exposure amount relatively increases, for example, even a minute exposure may possibly advance deterioration of the photosensitive drum.

The invention according to the present application has been made in consideration of circumstances such as that described above, and an object thereof is to appropriately control an exposure timing of a laser beam in a start-up period of a rotating polygon mirror. Another object of the invention according to the present application is to control a minute light emission amount in accordance with a speed of a rotating polygon mirror in a start-up period of the rotating polygon mirror.

In order to achieve the object described above, an image forming apparatus, includes:

a photosensitive member;

a developing portion configured to switch between a contact state where the developing portion comes into contact with the photosensitive member and a separation state where the developing portion separates from the photosensitive member, and develop a toner image on the photosensitive member in the contact state;

an irradiating portion configured to irradiate light;

a rotating polygon mirror configured to reflect light irradiated from the irradiating portion and scan an image region and a non-image region on the photosensitive member;

a detecting portion configured to detect light reflected by the rotating polygon mirror; and a control portion configured to control so that light is irradiated from the irradiating portion in a first light emission amount for forming an electrostatic latent image in an image portion and in a second light emission amount for controlling a potential of a non-image portion, the second light emission amount being smaller than the first light emission amount, wherein the control portion controls so that:

when the photosensitive member and the developing portion are in the separation state, and in a start-up period in which a rotational speed of the rotating polygon mirror is controlled such that the rotating polygon mirror rotates at a prescribed rotational speed, a first light emission is performed in which the irradiating portion is caused to scan the image region and the non-image region;

when light is detected at least twice by the detecting portion during a first period when the first light emission is being performed, a second light emission is performed in which the irradiating portion is caused to scan the non-image region;

when a prescribed period of time has elapsed from the start of the second light emission, a third light emission is performed in which the image region is scanned in a third light emission amount that is smaller than the second light emission amount during a second period in which the photosensitive member makes at least one revolution; and after the third light emission is performed, the photosensitive member and the developing portion are switched to the contact state.

In order to achieve another object described above, an image forming apparatus, includes:

an image bearing member configured to be rotationally driven;

an irradiating portion which has a rotating polygon mirror that reflects light emitted from a light source toward the image bearing member and configured to irradiate light from the light source to the image bearing member to form a latent image;

a control portion configured to control so as to cause light from the light source to be irradiated to the image bearing member in a first light emission amount for forming the latent image in an image portion and in a second light emission amount for controlling a potential of a non-image portion, the second light emission amount being smaller than the first light emission amount; and an acquiring portion configured to acquire information related to a rotational speed of the rotating polygon mirror and a rotational speed of the image bearing member, wherein the control portion determines the second light emission amount that is emitted from the light source in a start-up period of the rotating polygon mirror performed prior to image formation, based on a correspondence relationship between information related to the rotational speed of the rotating polygon mirror and the rotational speed of the image bearing member acquired by the acquiring portion, and the second light emission amount.

According to the present invention, an exposure timing of a laser beam can be appropriately controlled in a start-up period of a rotating polygon mirror. In addition, according to the present invention, a minute light emission amount can be controlled in accordance with a speed of a rotating polygon mirror in a start-up period of the rotating polygon mirror. Further features of the present invention will become apparent from the following description of exemplary embodiments with reference to the attached drawings.

BRIEF DESCRIPTION OF THE DRAWINGS

FIG. 7 is a flow chart illustrating activation control of the scanning apparatus 112;

DESCRIPTION OF THE EMBODIMENTS

Hereinafter, embodiments of the present invention will be described with reference to the drawings. Note that the embodiments described below are not intended to limit the invention pertaining to the scope of claims, and not all combinations of features described in the embodiments are needed for solutions provided by the invention. In addition, it is to be understood that dimensions, materials, shapes, relative arrangements, and the like of components described in the embodiments are intended to be changed as deemed appropriate in accordance with configurations and various conditions of apparatuses to which the invention is to be applied and are not intended to limit the scope of the invention to the embodiments described below.

First Embodiment

Image Forming Apparatus

Figure 1:
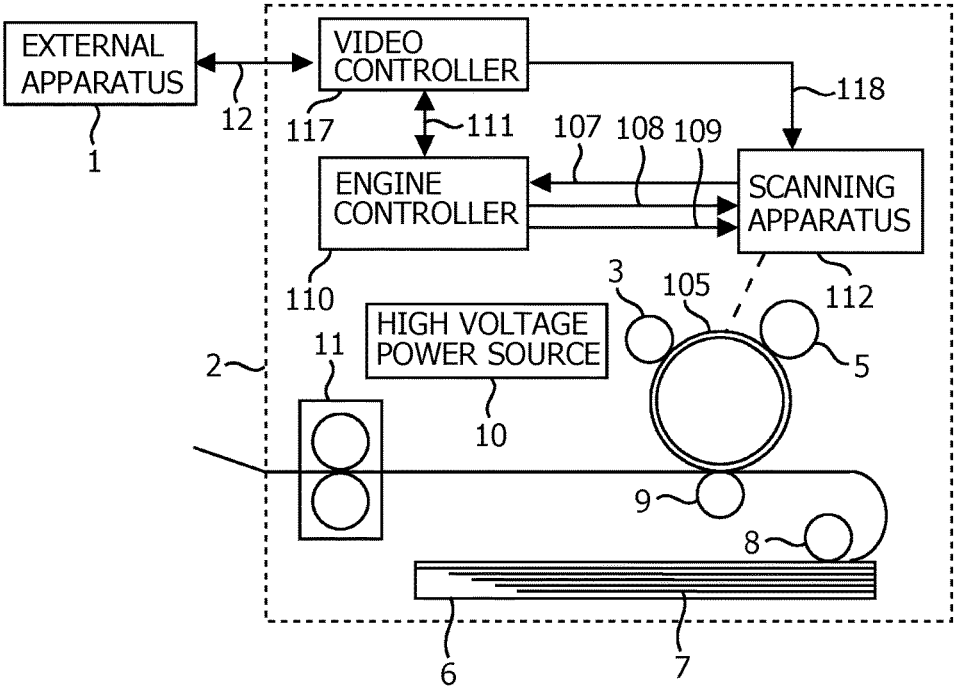
FIG. 1 is a schematic configuration diagram of an image forming apparatus 2.

FIG. 1 is a schematic configuration diagram of an image forming apparatus 2. While a description will be given below using a monochromatic image forming apparatus, the image forming apparatus 2 is not limited thereto. Minute light emission of a non-image portion to be described in detail later is also applicable to, for example, a color image forming apparatus. In addition, the color image forming apparatus may adopt an in-line system using an intermediate transfer belt, a rotary system, or a direct transfer system.

The image forming apparatus 2 can be connected to an external apparatus 1 such as a PC. The image forming apparatus 2 has an engine controller 110 which is an example of a control portion, and a video controller 117. The engine controller 110 controls operations of various members inside the image forming apparatus. The video controller 117 is connected to the external apparatus 1 by a general-purpose interface 12, and expands image data sent from the external apparatus 1 to bit data and sends the bit data to a scanning apparatus 112 as an image signal 118. The engine controller 110 and the video controller 117 are connected by an interface signal 111.

When a print start instruction is issued from the external apparatus 1, the engine controller 110 causes a charging roller 3 to uniformly charge a surface of a photosensitive drum 105 as a photosensitive member. Subsequently, with respect to the surface of the photosensitive drum 105, exposure scanning by a laser beam is performed by the scanning apparatus 112 based on the image signal 118 sent from the video controller 117 and an electrostatic latent image is formed. Detailed descriptions of a configuration of the scanning apparatus 112 and control of exposure scanning by a laser beam will be provided later.

The formed electrostatic latent image is developed by toner (a developer) held on a surface of a developing roller 5 to form a toner image on the photosensitive drum 105 (on the photosensitive member). Note that the developing roller 5 is configured so as to be movable between a contact position representing a contact state in which the developing roller 5 is in contact with the photosensitive drum 105 and a separation position representing a separation state in which the developing roller 5 is separated from the photosensitive drum 105. The developing roller 5 is controlled so as to be positioned at the contact position during an image formation period and at the separation position during a non-image formation period.

Next, a recording material 7 which is, for example, paper and which is stored in a paper feeding cassette 6 is fed by a paper feeding roller 8. The toner image formed on the photosensitive drum 105 is transferred onto the recording material 7 by a transfer roller 9 in accordance with a transport operation of the fed recording material 7. The charging is performed as a charging bias output from a high-voltage power supply 10 is supplied to the charging roller 3. The development is performed as a developing bias is supplied to the developing roller 5. The transfer is performed as a transfer bias is supplied to the transfer roller 9. The recording material 7 to which the toner image has been transferred is transported to a fixing apparatus 11, the toner image is fixed onto the recording material 7 by heat and pressure, and the fixed recording material 7 is discharged to the outside of the image forming apparatus.

Scanning Apparatus

Figure 2:
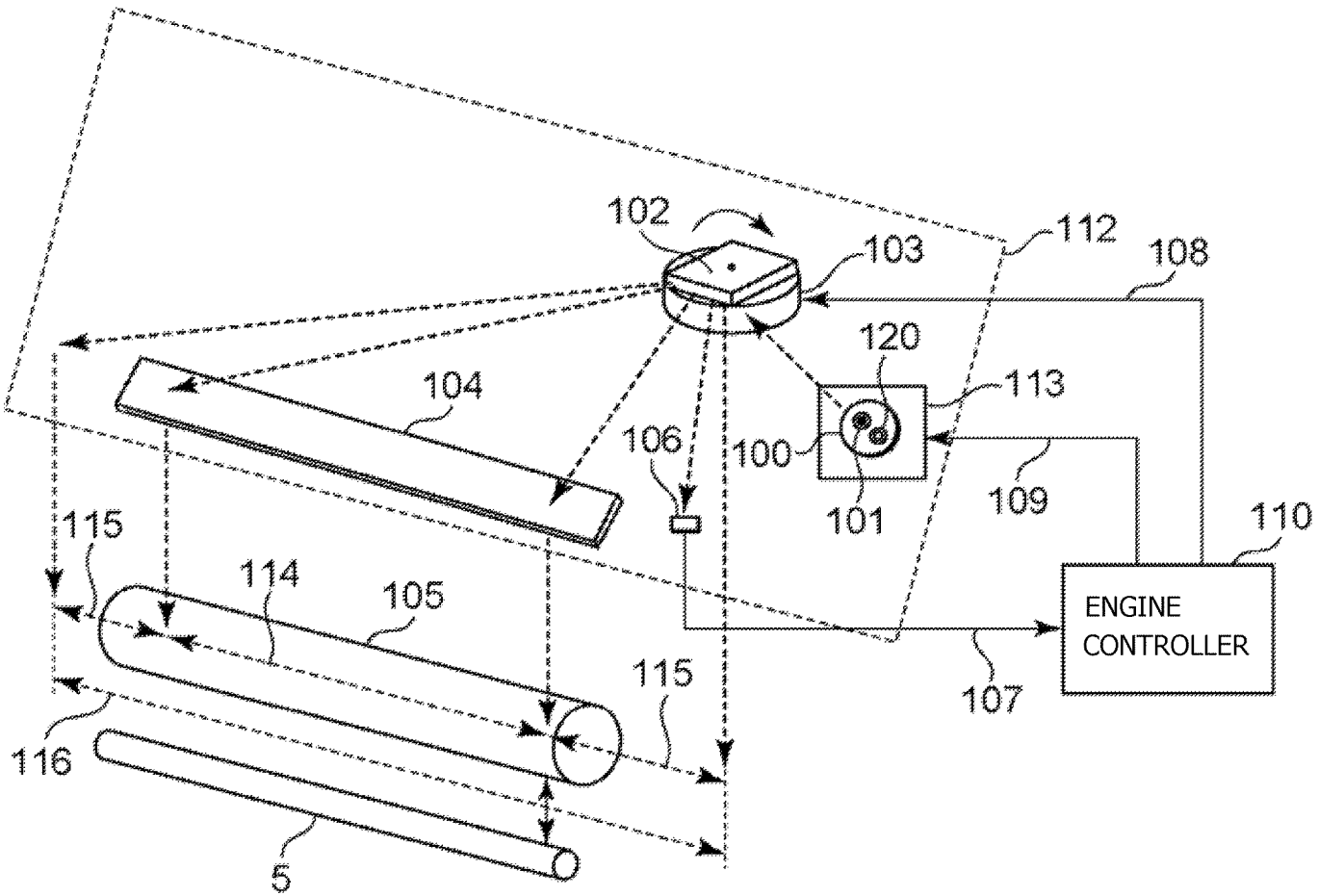
FIG. 2 is a perspective view illustrating a schematic configuration of a scanning apparatus 112.

FIG. 2 is a perspective view illustrating a schematic configuration of the scanning apparatus 112. A semiconductor laser 100 is a light source for exposing images. The semiconductor laser 100 is constituted by a laser diode 101 and a photodiode 120, and light emission control of the semiconductor laser 100 is performed by a laser driving circuit 113. A detailed description of a control operation of the semiconductor laser 100 by the laser driving circuit 113 will be provided later.

A scanner motor 103 that represents an example of a driving portion which rotates a polygonal mirror 102 as a rotating polygon mirror rotates the polygonal mirror 102 in an illustrated rotation direction. A laser beam reflected by each surface of the rotationally-driven polygonal mirror 102 periodically scans an entire scanning region 116. In other words, the polygonal mirror 102 is capable of scanning the photosensitive drum 105 by reflecting laser beams. The entire scanning region 116 is made up of an image region 114 and a non-image region 115. The image region 114 is a region where laser light reflected by the polygonal mirror 102 irradiates the surface of the photosensitive drum 105 via a reflective mirror 104. An electrostatic latent image can be formed on the photosensitive drum 105 by scanning the image region 114 with a laser beam.

On the other hand, the non-image region 115 is a region excluding the image region 114 in the entire scanning region 116. A BD (Beam Detect) sensor 106 provided in a prescribed region in the non-image region 115 generates a horizontal synchronization signal (main scanning synchronization signal) 107 in response to incidence of a laser beam as a signal corresponding to the laser beam. Hereinafter, the horizontal synchronization signal 107 is also referred to as a BD signal 107. In addition, a period in which the BD signal 107 is generated is also referred to as a BD period. The BD signal 107 is used as a scanning start reference signal in a main scanning direction to control a writing start position in the main scanning direction.

The engine controller 110 sequentially stores a BD period every time the BD signal 107 is generated. In addition, the engine controller 110 controls the scanner motor 103 and the semiconductor laser 100 based on the stored BD periods. Specifically, the engine controller 110 transmits a scanner motor drive signal 108 to the scanner motor 103. In addition, speed control is performed so that the number of revolutions of the scanner motor 103 converges to a set target number of revolutions by increasing the speed of the scanner motor 103 when the number of revolutions determined from a current BD period is lower than the target number of revolutions and reducing the speed when the number of revolutions is higher than the target number of revolutions. Furthermore, the engine controller 110 transmits a laser drive signal 109 to the laser driving circuit 113 and controls the semiconductor laser 100 so as to emit light at a prescribed timing in the entire scanning region 116.

Laser Driving Circuit

Figure 3:
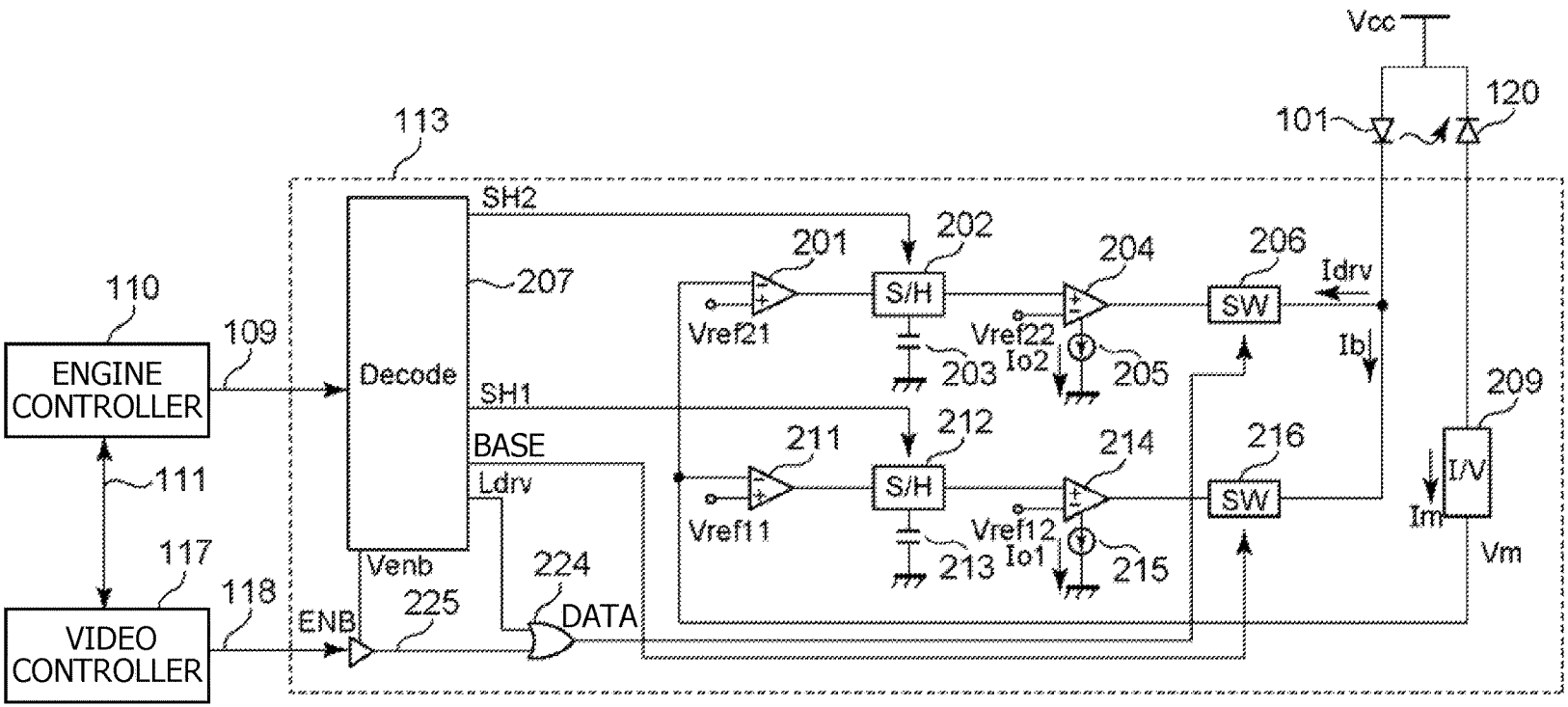
FIG. 3 is a configuration diagram of a laser driving circuit 113.

FIG. 3 is a configuration diagram of the laser driving circuit 113. The laser diode 101 and the photodiode 120 which constitute the semiconductor laser 100 are connected to the laser driving circuit 113. In addition, the laser drive signal 109 is to be transmitted from the engine controller 110 and the image signal 118 is to be transmitted from the video controller 117. In accordance with the image signal 118 transmitted from the video controller 117, the laser driving circuit 113 performs minute light emission of a light amount small enough to prevent toner from being developed with respect to the non-image portion on the photosensitive drum 105 which is a region corresponding to a margin. In addition, in accordance with the image signal 118, with respect to the image portion on the photosensitive drum 105 which is a region in which a toner image is formed, the laser driving circuit 113 performs normal light emission in accordance with density of the image to be formed.

In this manner, the semiconductor laser 100 can be caused to emit light in light amounts of two levels. Hereinafter, such two-level light emission control will also be referred to as background exposure control. In addition, in order to appropriately control the respective light amounts in the two-level light-emitting state, the laser driving circuit 113 is equipped with a function for performing APC (Automatic Power Control) which automatically adjusts and stabilizes a laser light amount of the semiconductor laser 100.

Reference numerals 201 and 211 denote comparator circuits, 202 and 212 denote sampling/holding circuits, and 203 and 213 denote holding capacitors. In addition, reference numerals 204 and 214 denote current amplifier circuits, 205 and 215 denote reference current sources (constant current circuits), 206 and 216 denote switching circuits, and 209 denotes a current-voltage conversion circuit. Furthermore, while a detailed description will be provided later, a portion constituting components 211 to 216 corresponds to an operating portion of a minute light emission APC and a portion constituting components 201 to 206 corresponds to an operating portion of a normal light emission APC. Reference numeral 207 denotes a decode circuit which decodes the laser drive signal 109 transmitted from the engine controller 110. In addition, the decode circuit 207 is configured to output an SH1 signal, an SH2 signal, a Base signal, an Ldrv signal, and a Venb signal to each part of the laser driving circuit 113.

The image signal 118 output from the video controller 117 is input to a buffer 225 with an enable terminal. An output of the buffer 225 with an enable terminal and the Ldrv signal are connected to an input of an OR circuit 224. An output signal Data of the OR circuit 224 is connected to the switching circuit 206. In addition, the enable terminal of the buffer 225 with an enable terminal is connected to the Venb signal.

First reference voltage Vref11 and second reference voltage Vref21 are respectively input to positive electrode terminals of the comparator circuits 211 and 201, and outputs of the comparator circuits 211 and 201 are respectively input to the sampling/holding circuits 212 and 202. Holding capacitors 213 and 203 are respectively connected to the sampling/holding circuits 212 and 202. The reference voltage Vref11 is set as target voltage of a light emission level for minute light emission. In a similar manner, the reference voltage Vref21 is set as target voltage of a light emission level for normal light emission.

Outputs of the holding capacitors 213 and 203 are respectively input to positive electrode terminals of the current amplifier circuits 214 and 204. The reference current sources 215 and 205 are respectively connected to the current amplifier circuits 214 and 204, and outputs of the current amplifier circuits 214 and 204 are input to the switching circuits 216 and 206. Meanwhile, third reference voltage Vref12 and fourth reference voltage Vref22 are respectively input to negative electrode terminals of the current amplifier circuits 214 and 204. In this case, a current Io1 (a first driving current) and a current Io2 (a second driving current) are respectively determined in accordance with differences between output voltages of the sampling/holding circuits 212 and 202 and the reference voltages Vref12 and Vref22. In other words, Vref12 and Vref22 are voltage settings for determining currents.

The switching circuit 216 is switched on and off by an input signal Base. The switching circuit 206 is switched on and off by a pulse-modulated data signal Data. Output terminals of the switching circuits 216 and 206 are connected to a cathode of the laser diode 101 and supply driving currents Ib and Idrv. An anode of the laser diode 101 is connected to a power supply Vcc. A cathode of the photodiode 120 which monitors a light amount of the laser diode 101 is connected to the power supply Vcc. An anode of the photodiode 120 is connected to the current-voltage conversion circuit 209 and generates monitor voltage Vm by passing a monitor current Im through the current-voltage conversion circuit 209. The monitor voltage is negatively fed back to negative electrode terminals of the comparator circuits 211 and 201.

Hereinafter, details of the minute light emission APC and the normal light emission APC will be described. In the minute light emission APC, according to an instruction from the engine controller 110, the decode circuit 207 sets the sampling/holding circuit 202 to a hold state (a non-sampling state) via the SH2 signal. At the same time, the decode circuit 207 sets the switching circuit 206 to an OFF state via the input signal Data. In relation to the input signal Data, the Venb signal connected to the enable terminal of the buffer 225 with an enable terminal is set to a disabled state, and the Ldrv signal is controlled to set the input signal Data to an OFF state. Furthermore, the decode circuit 207 sets the sampling/holding circuit 212 to a sampling state via the SH1 signal and sets the switching circuit 216 to an ON state via the input signal Base. A period in which the sampling/holding circuit 212 is in the sampling state corresponds to a period in which the light emission level for minute light emission is automatically adjusted. In this period, the driving current Ib is supplied to the laser diode 101.

When the laser diode 101 emits light in this state, the photodiode 120 monitors a light emission amount of the laser diode 101 and generates a monitor current Im1 proportional to the light emission amount. Monitor voltage Vm1 is generated by passing the monitor current Im1 through the current-voltage conversion circuit 209. In addition, the current amplifier circuit 214 adjusts the driving current Ib based on Io1 that flows through the reference current source 215 so that the monitor voltage Vm1 matches the first reference voltage Vref11 that is a target value. Furthermore, when executing the normal light emission APC and during a normal image formation period (a period in which the image signal 118 is being sent), the sampling/holding circuit 212 is in the hold state and the light emission level for minute light emission is maintained.

On the other hand, in the normal light emission APC, according to an instruction from the engine controller 110, the decode circuit 207 sets the sampling/holding circuit 212 to a hold state (a non-sampling state) via the SH1 signal. At the same time, the decode circuit 207 sets the switching circuit 216 to an ON state via the input signal Base. Accordingly, a state is created where the driving current Ib is supplied to the laser diode 101. Furthermore, the decode circuit 207 sets the sampling/holding circuit 202 to a sampling state via the SH2 signal and sets the switching circuit 206 to an ON operational state via the input signal Data. More specifically, at this point, the Ldrv signal is controlled and the input signal Data is set so as to create a light-emitting state of the laser diode 101. The period in which the sampling/holding circuit 202 is in the sampling state corresponds to a period in which the light emission level for normal light emission is automatically adjusted. In this period, Ib+Idrv obtained by superimposing the driving current Idrv on the driving current Ib is supplied to the laser diode 101.

When the laser diode 101 emits light in this state, the photodiode 120 monitors a light emission amount of the laser diode 101 and generates a monitor current Im2 (Im2>Im1) proportional to the light emission amount. Monitor voltage Vm2 is generated by passing the monitor current Im2 through the current-voltage conversion circuit 209. In addition, the current amplifier circuit 204 adjusts the driving current Idrv based on the current Io2 that flows through the reference current source 205 so that the monitor voltage Vm2 matches the second reference voltage Vref21 that is a target value. Furthermore, in a normal image formation period, the sampling/holding circuit 202 is in the hold state, the switching circuit 206 is switched ON/OFF in accordance with the input signal data Data, and pulse width modulation is applied to the driving current Idrv.

As described above, the laser driving circuit 113 has operating portions for performing two APCs for minute light emission and normal light emission. The minute light emission APC adjusts the driving current Ib so that minute light emission is performed on the non-image portion on the photosensitive drum 105 in a desired light emission level. On the other hand, the normal light emission APC adjusts the driving current Idrv in the driving current Ib+Idrv obtained by superimposing the driving current Idrv on the driving current Ib so that normal light emission is performed on the image portion on the photosensitive drum 105 in a desired light emission level. Note that, while an example in which the laser diode 101 and the photodiode 120 are built into the semiconductor laser 100 has been described, a configuration may be adopted in which the function of the photodiode 120 is provided outside of the semiconductor laser 100.

Figure 4:
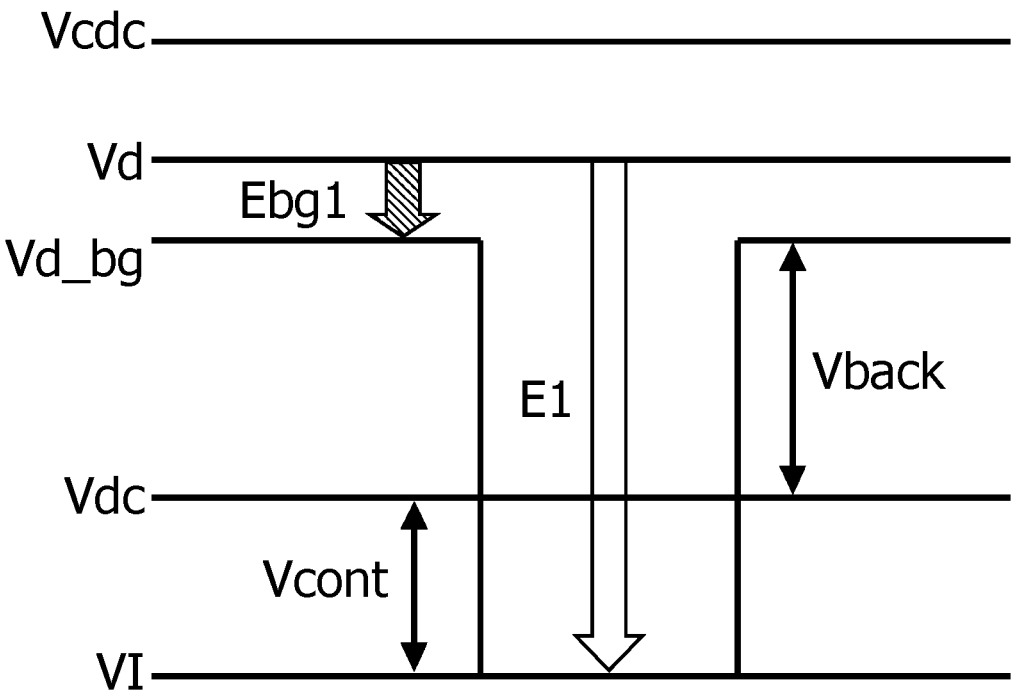
FIG. 4 is a diagram illustrating a potential change of a photosensitive drum 105 related to minute light emission.

Explanation of Potential Change of Photosensitive Drum 105 Related to Minute Light Emission Minute light emission will now be described in further detail with reference to FIG. 4. A charging bias Vcdc applied to the photosensitive drum 105 by the high-voltage power supply 10 via the charging roller 3 appears as a charging potential Vd on the surface of the photosensitive drum 105. The charging potential Vd is set to a higher potential than a charging potential of the non-image portion during toner development.

In addition, in the non-image portion, the charging potential Vd is attenuated to a charging potential Vd_bg by laser emission at a minute light emission level Ebg1. Applying the charging bias Vcdc may result in the occurrence of a higher potential than a convergence potential at several locations on the surface of the photosensitive drum 105, thereby increasing a back contrast Vback that is a contrast between a developing potential Vdc and the charging potential Vd and inducing inverse fogging. Conversely, by attenuating the charging potential Vd to the charging potential Vd_bg by a laser emission of minute light emission Ebg1, residual potential that is higher than the convergence potential can be reduced and inverse fogging can be suppressed. In addition, the appearance of a transfer memory in Vd is also well known. The laser emission of the minute light emission Ebg1 can also reduce such a transfer memory and suppress the occurrence of a ghost image attributable to the transfer memory.

Furthermore, the laser emission of the minute light emission Ebg1 also has a function of setting a proper back contrast Vback that is a difference between the developing potential Vdc and the charging potential. Occurrences of positive fogging and inverse fogging of toner can be suppressed even from this perspective. At the same time, a development contrast Vcont (=Vdc−V1) that is a difference value between the developing potential Vdc and an exposure potential V1 can also be made proper. As a result, a decline in development efficiency can be suppressed. In addition, an occurrence of sweeping can be suppressed. Furthermore, margins for transfer and retransfer can be secured.

In addition, the charging bias Vcdc described above is variably set in accordance with the environment or deterioration (usage) of the photosensitive drum 105. Accordingly, a light amount of minute light emission is also variably set. For example, when the value of the charging bias Vcdc increases, the light amount of the minute light emission Ebg1 also increases, and when the value of the charging bias Vcdc decreases, the light amount of the minute light emission Ebg1 also decreases.

Control During Activation of Scanning Apparatus 112

Figure 5:
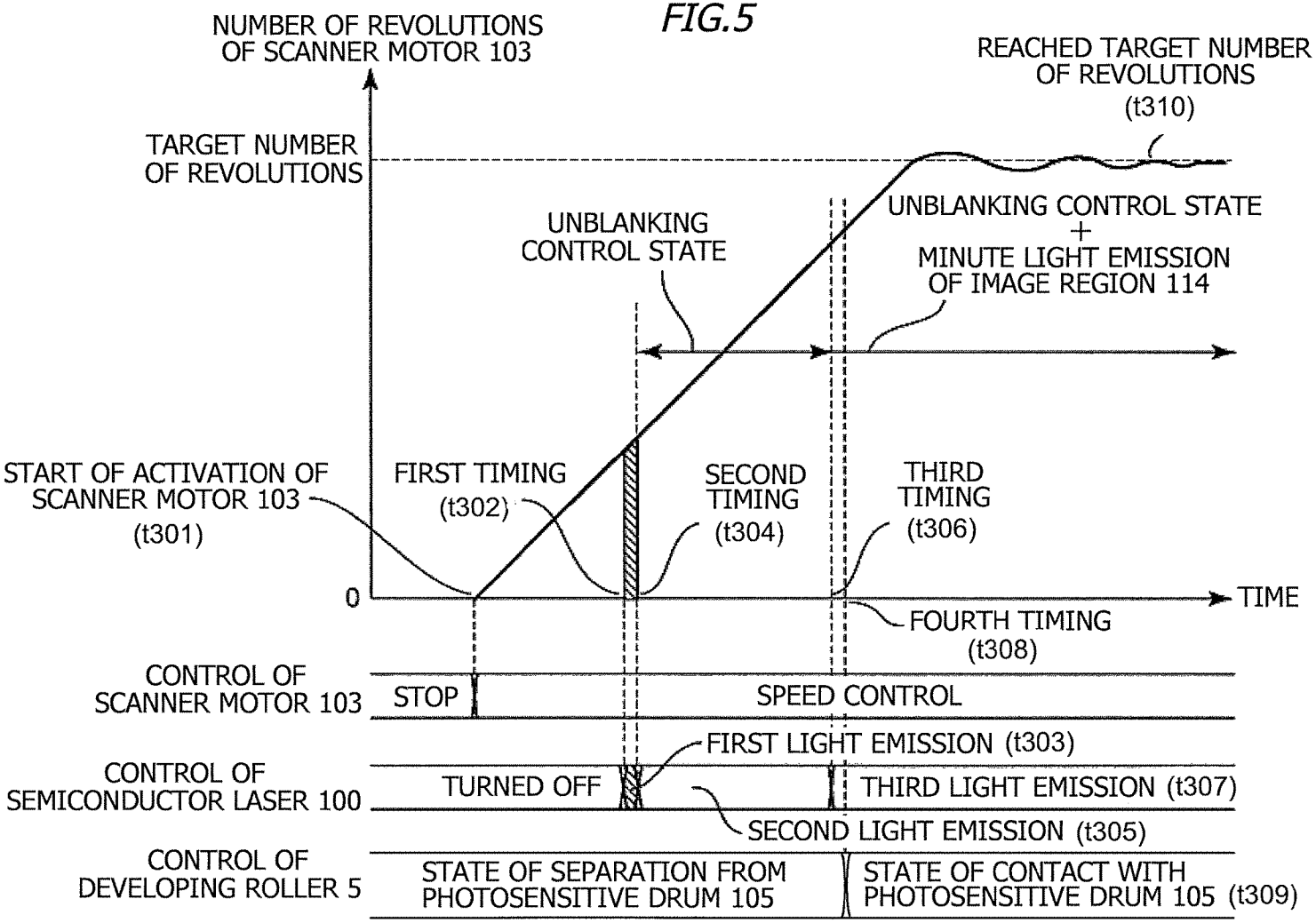
FIG. 5 is a characteristic diagram illustrating a change in the number of revolutions from start of activation of a scanner motor 103.
Figure 6:
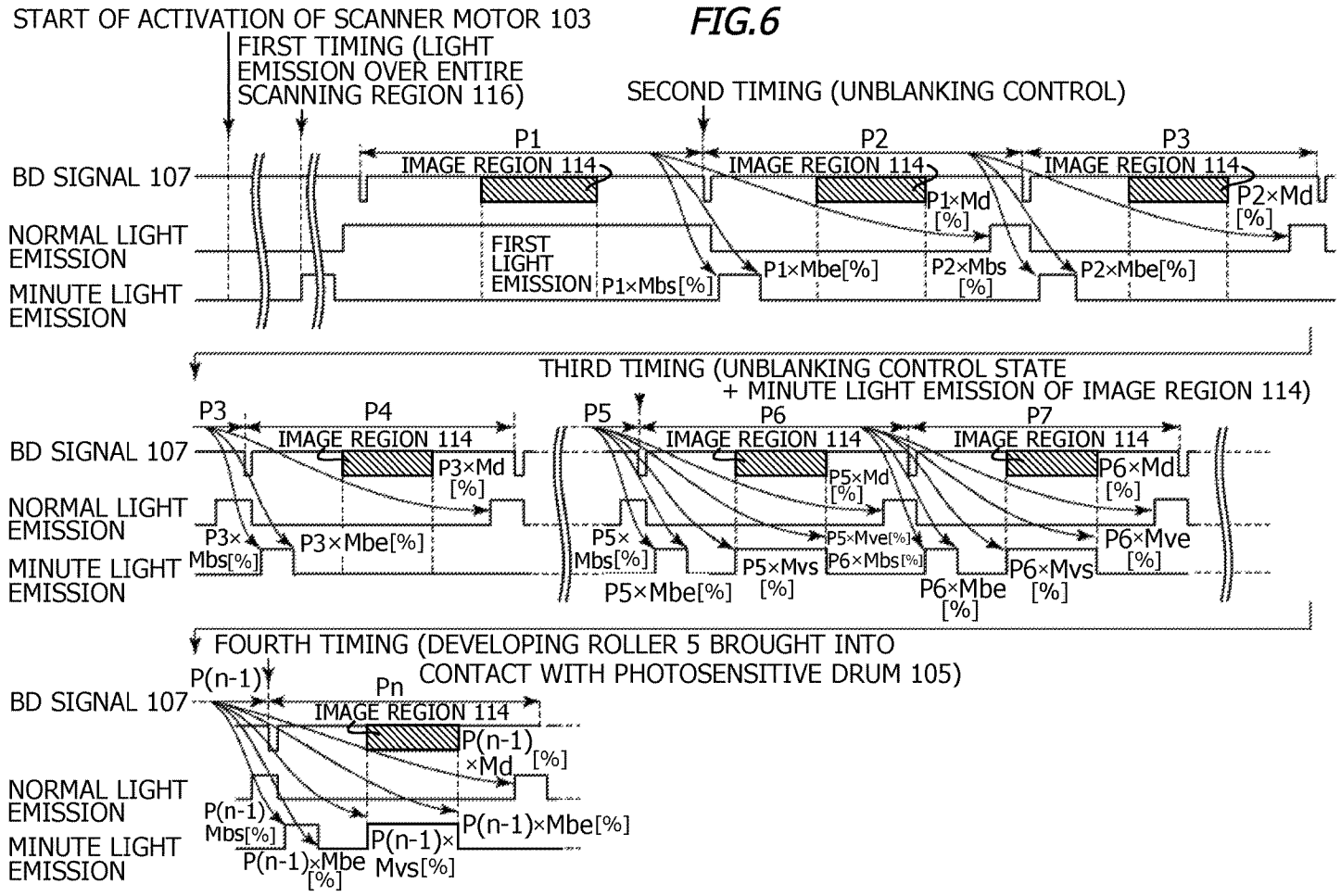
FIG. 6 is a timing chart of signals related to activation control of the scanning apparatus 112.

Next, control during activation of the scanning apparatus 112 will be described. FIG. 5 is a characteristic diagram illustrating a change in the number of revolutions from start of activation of the scanner motor 103, in which an abscissa represents time and an ordinate represents the number of revolutions of the scanner motor 103. Control states of the scanner motor 103, the semiconductor laser 100, and the developing roller 5, which are controlled by the engine controller 110, are also illustrated. FIG. 6 is a timing chart of signals related to activation control of the scanning apparatus 112. The BD signal 107 and normal light emission (print light emission) and minute light emission of the semiconductor laser 100 are illustrated. In FIG. 6, the BD signal 107 is a signal which assumes a high level when a BD sensor 106 does not receive a laser beam and which assumes a low level when the BD sensor 106 receives a laser beam. In addition, normal light emission and minute light emission of the semiconductor laser 100 are signals of which a low level is a turned-off state and a high level is a state where a laser beam is emitted and APC is being performed.

When print start is instructed, at a prescribed timing after the occurrence of the instruction of print start, the engine controller 110 starts activation control of the scanner motor 103 in accordance with the scanner motor drive signal 108. At this point, the developing roller 5 is at a separation position where the developing roller 5 is separated from the photosensitive drum 105. The scanner motor 103 operates at a target number of revolutions that is a set prescribed number of revolutions and under a speed control instruction by the engine controller 110, and the polygonal mirror 102 starts rotating as the scanner motor 103 rotates. In this case, since the semiconductor laser 100 is in the turned-off state and the BD signal 107 is not generated, the scanner motor 103 is instructed to increase speed (t301). In other words, a period from the start of activation control to the polygonal mirror 102 reaching a target rotational speed in this manner can also be referred to as a start-up period of the polygonal mirror 102.

At a first timing after a prescribed time has elapsed from the start of activation of the scanner motor 103 (t302), the engine controller 110 causes light emission (first light emission) of the semiconductor laser 100 over the entire scanning region 116 (t303). In this manner, t302 to t303 represent a light emission period of the first light emission. Immediately after the activation of the scanner motor 103, the number of revolutions of the scanner motor 103 is small and a scanning speed of the polygonal mirror 102 is also slow. Therefore, energy when the photosensitive drum 105 is irradiated with a laser beam increases as compared to than when the polygonal mirror 102 is rotating at a high speed at which an image is normally formed and may advance deterioration of the photosensitive drum 105.

Therefore, between the start of activation of the scanner motor 103 (t301) and the first timing (t302), the semiconductor laser 100 is kept in the turned-off state to ensure that the photosensitive drum 105 is not exposed. In addition, by starting light emission of the semiconductor laser 100 after the scanner motor 103 reaches a stable accelerated state, unwanted deterioration of the photosensitive drum 105 is suppressed. Note that the first light emission may be realized by executing one of or both of the minute light emission APC and the normal light emission APC. FIG. 6 illustrates an example in which, as the first light emission, normal light emission APC is performed after performing minute light emission APC.

The semiconductor laser 100 performs APC by performing the first light emission. As the laser light amount of the semiconductor laser 100 increases due to APC, the BD signal 107 in accordance with a laser beam periodically received by the BD sensor 106 is eventually generated. The engine controller 110 updates and stores a BD period every time the BD signal 107 is generated. As illustrated in FIG. 6, when the BD signal 107 is generated in plurality (in this case, twice) by the first light emission of the semiconductor laser 100 or, in other words, when light is detected at least twice by the BD sensor 106, a BD period P1 is determined from two BD signals 107. The determined BD period P1 is stored in a memory as a storage portion.

Once the BD period P1 is determined, the engine controller 110 performs control (hereinafter, also referred to as unblanking control) for causing the semiconductor laser 100 to emit light in the non-image region 115. To this end, the unblanking control is started after a second timing (t304) at which the second BD signal 107 is generated. First, at the second timing (t304), the engine controller 110 calculates a value P1×Md [%] by multiplying an immediately-previously updated BD period P1 by a set value Md set in advance. In addition, at a timing when P1×Md [%] has elapsed from the timing at which the BD signal 107 had been acquired, normal light emission APC for acquiring a next BD signal 107 is performed. Since this light emission is unblanking control, the light emission is performed in the non-image region 115, and the next BD signal 107 is acquired as a laser beam is received by the BD sensor 106. Once the BD signal 107 is acquired, the semiconductor laser 100 is stopped so as not to emit light in the image region 114. In this case, t304 to t306 represent a light emission period of the second light emission.

In a similar manner, the engine controller 110 calculates a value P1×Mbs [%] by multiplying an immediately-previously updated BD period P1 by a set value Mbs set in advance. In addition, at a timing when P1×Mbs [%] has elapsed from the timing at which the BD signal 107 had been acquired, minute light emission APC is performed. Note that a timing at which the minute light emission APC is ended is obtained in a similar manner to the start timing of the minute light emission by calculating a value P1×Mbe [%] by multiplying an immediately-previously updated BD period P1 by a set value Mbe set in advance. In addition, at a timing when P1×Mbe [%] has elapsed from the timing at which the BD signal 107 had been acquired, the semiconductor laser 100 is stopped so as not to emit light in the image region 114.

The second light emission is performed by sequentially determining light emission timings thereof as the BD periods P1, P2, P3, . . . , Pn stored in the engine controller 110 are updated. In this case, since speed control of the scanner motor 103 is increasing the speed of the scanner motor 103 toward the target number of revolutions, a variation amount (rate of change) between adjacent BD periods is small even though there is a trend of BD periods gradually becoming shorter. Therefore, by determining a light emission timing during a next scan from previously stored BD period information, unblanking control is realized in which light is emitted in the non-image region 115 and, at the same time, a next BD signal 107 is acquired. In other words, the set value Md is set based on a timing at which light is emitted in the non-image region 115 and a next BD signal 107 is acquired. In a similar manner, the set values Mbs and Mbe are set based on timings at which light is emitted in the non-image region 115. Moreover, while a sufficient light amount for acquiring the BD signal 107 is acceptable, control for acquiring the BD signal 107 by APC of normal light emission with a larger light amount is desirable.

As illustrated in FIG. 6, by performing normal light emission APC at light emission timings determined by P1×Md, P2×Md, P3×Md, Pn×Md, both light emission in the non-image region 115 and acquisition of the next BD signal 107 are realized. Furthermore, by performing minute light emission APC at light emission timings determined by P1×Mbs, P1×Mbe, P2×Mbs, P2×Mbe, Pn×Mbs, Pn×Mbe, light emission in the non-image region 115 is realized. While a case where a switch to unblanking control is made at a timing at which BD signals are acquired twice has been described as an example, this case is not restrictive. Although the switch to unblanking control may be made after any number of acquisitions of BD signals as long as the number is equal to or larger than two, the switch to unblanking control once BD signals are acquired twice is preferable in terms of suppressing deterioration of the photosensitive drum 105.

Next, in order to reduce a first print-out time (FPOT), the engine controller 110 controls a timing at which the developing roller 5 is brought into contact with the photosensitive drum 105. Generally, in control for bringing the developing roller 5 into contact with the photosensitive drum 105, there is a large mechanical variation during a period from the engine controller 110 instructing a contact/separation mechanism (not illustrated) to start contact to completion of the contact operation. Therefore, in consideration of the period of variation, completing the contact operation of the developing roller 5 and the photosensitive drum 105 before start-up of the scanner motor 103 is completed enables the FPOT to be shortened.

However, as explained in the description of the potential change of the photosensitive drum 105 related to minute light emission provided earlier, when bringing the developing roller 5 into contact with the photosensitive drum 105, minute light emission is preferably performed on the image region 114 on the photosensitive drum 105 in advance to suppress occurrences of positive fogging and inverse fogging of toner. In other words, a switch is preferably made to control for minute light emission of the image region 114 in preparation of contact after a prescribed period of time has elapsed from the second light emission (t305) in which normal light emission APC and/or minute light emission APC are performed in the non-image region 115 so as to avoid the image region 114.

In this case, the engine controller 110 estimates a minute light emission energy amount when performing minute light emission on the image region 114 based on a cumulative time of subjecting the semiconductor laser 100 to minute light emission APC or the current number of revolutions of the scanner motor 103. Specifically, the minute light emission energy amount is estimated based on a degree of attainment of a target minute light emission level as determined from the cumulative time of subjecting the semiconductor laser 100 to minute light emission APC and a scanning speed of the scanner motor 103 when minute light emission is performed on the image region 114 based on the current number of revolutions of the scanner motor 103.

For example, when it takes 10 msec to reach the target minute light emission level after the completion of minute light emission APC, the engine controller 110 determines whether or not a cumulative time of performing minute light emission APC is equal to or longer than 10 msec. In addition, even at the same light emission level, the slower the scanning speed, the larger the minute light emission energy to the image region 114 and, conversely, the higher the scanning speed, the smaller the minute light emission energy to the image region 114. In other words, the engine controller 110 estimates the minute light emission energy based on a value obtained by dividing the current minute light emission level by the current scanning speed. In this manner, for example, the engine controller 110 determines that the current number of revolutions of the scanner motor 103 has equaled or exceeded 20,000 rpm.

Furthermore, the engine controller 110 determines whether or not the back contrast Vback as defined by the estimated minute light emission energy amount is within a prescribed threshold range and is a value at which positive fogging and inverse fogging of toner do not occur. Note that the minute light emission energy amount before the developing roller 5 and the photosensitive drum 105 come into contact with each other is a smaller value than the minute light emission energy amount after start-up of the scanner motor 103 is completed.

After a third timing (t306) at which the engine controller 110 determines that the minute light emission energy amount is within the prescribed threshold range as described above, the engine controller 110 starts minute light emission (third light emission) to the image region 114 in addition to the second light emission (unblanking control). The timing of minute light emission to the image region 114 is obtained in a similar manner to the second light emission by calculating a value P5×Mvs [%] by multiplying an immediately-previously updated BD period P5 by a set value Mvs set in advance. In addition, at a timing when P5×Mvs [%] has elapsed from the timing at which the BD signal 107 had been acquired, the third light emission is performed.

Note that a timing at which the minute light emission APC to the image region 114 is ended is obtained in a similar manner to the start timing of the minute light emission by calculating a value P5×Mve [%] by multiplying an immediately-previously updated BD period P5 by a set value Mve set in advance. In addition, at a timing when P5×Mve [%] has elapsed from the timing at which the BD signal 107 had been acquired, the minute light emission APC in the image region 114 is ended. As described above, the set values Mvs and Mve are set based on timings at which light can be minutely emitted in the image region 114. When performing minute light emission in the image region 114, light emission is desirably controlled by placing the sampling/holding circuit 212 in a hold state and emitting light while maintaining a light emission level of minute light emission so that the back contrast Vback falls within a prescribed number threshold range.

The third light emission is performed by sequentially determining light emission timings thereof as the stored BD periods P5, P6, P7, . . . are updated. Subsequently, after a fourth timing (t308) at which the photosensitive drum 105 has made one revolution after starting the third light emission and a determination is made that minute light emission of the entire surface of the photosensitive drum 105 has been performed, the engine controller 110 brings the developing roller 5 into contact with the photosensitive drum 105 (t309). In this case, t306 to t308 represent a light emission period of the third light emission. Subsequently, when the scanner motor 103 reaches within one percent of the target number of revolutions (t310), the engine controller 110 determines that the start-up (activation) of the scanner motor 103 has been completed. As a result of being subjected to APC, the light amount of the semiconductor laser 100 is adjusted to a desired light amount for normal light emission and a desired light amount for minute light emission suitable for image formation and becomes stable.

FIG. 7 is a flow chart illustrating activation control of the scanning apparatus 112. In S301, the engine controller 110 starts activation of the scanner motor 103. In S302, the engine controller 110 determines whether or not a prescribed time has elapsed from the activation of the scanner motor 103. When the prescribed time has elapsed, in S303, the engine controller 110 sets the semiconductor laser 100 to the first light emission in which light is emitted over the entire scanning region 116.

In S304, the engine controller 110 determines whether or not the BD signal 107 has been acquired twice. When the BD signal has been acquired twice, in S305, the engine controller 110 sets the semiconductor laser 100 to the second light emission in which light is emitted in the non-image region 115. In S306, the engine controller 110 determines whether or not the minute light emission energy amount of the semiconductor laser 100 has fallen within a prescribed threshold range. When the minute light emission energy amount is within the range, in S307, the engine controller 110 sets the semiconductor laser 100 to the third light emission in which light is emitted in the image region 114 in addition to the non-image region 115.

In S308, the engine controller 110 determines whether or not the photosensitive drum 105 has made one revolution after the start of the third light emission. When the photosensitive drum 105 has made one revolution, the engine controller 110 determines that preparation for bringing the developing roller 5 and the photosensitive drum 105 into contact with each other has been completed and, in S309, the engine controller 110 brings the developing roller 5 and the photosensitive drum 105 into contact with each other. In S310, the engine controller 110 determines whether or not the scanner motor 103 has reached the target number of revolutions. When the target number of revolutions has been reached, in S311, the engine controller 110 determines that the activation of the scanner motor 103 has been completed.

As described above, during activation of the scanning apparatus 112, when requisite BD signals can be detected in a period in which the first light emission is performed, a switch is made to the second light emission in which light is not emitted to the image region 114. Accordingly, by not undesirably extending a period of time in which the photosensitive drum 105 is irradiated by a laser beam, deterioration of the photosensitive drum 105 can be suppressed. In addition, after the second timing, APC is performed so that the semiconductor laser 100 emits laser light in the non-image region 115. Accordingly, the light amount of the semiconductor laser 100 can be adjusted and stabilized using a period until activation of the scanner motor 103 is completed. Therefore, since a period for performing APC is no longer separately provided, a first print-out time (FPOT) which is the time until a first image is formed can be shortened.

Furthermore, after the third timing, control is performed so that minute light emission is performed on the image region 114 in advance before the developing roller 5 and the photosensitive drum 105 come into contact with each other. Performing minute light emission of the image region 114 on the photosensitive drum 105 in advance enables occurrences of positive fogging and inverse fogging of toner to be suppressed. Moreover, due to the minute light emission of the image region 114, the developing roller 5 can be brought into contact with the photosensitive drum 105 before activation of the scanner motor 103 is completed and the first print-out time (FPOT) can be shortened.

Second Embodiment

In the first embodiment described above, a method of performing the third light emission before the developing roller 5 and the photosensitive drum 105 come into contact with each other is explained. In the present embodiment, control involving changing a target light emission level of the minute light emission APC during the third light emission will be described. Note that descriptions of components similar to those of the first embodiment such as the image forming apparatus and the scanning apparatus described above will be omitted.

Figure 8:
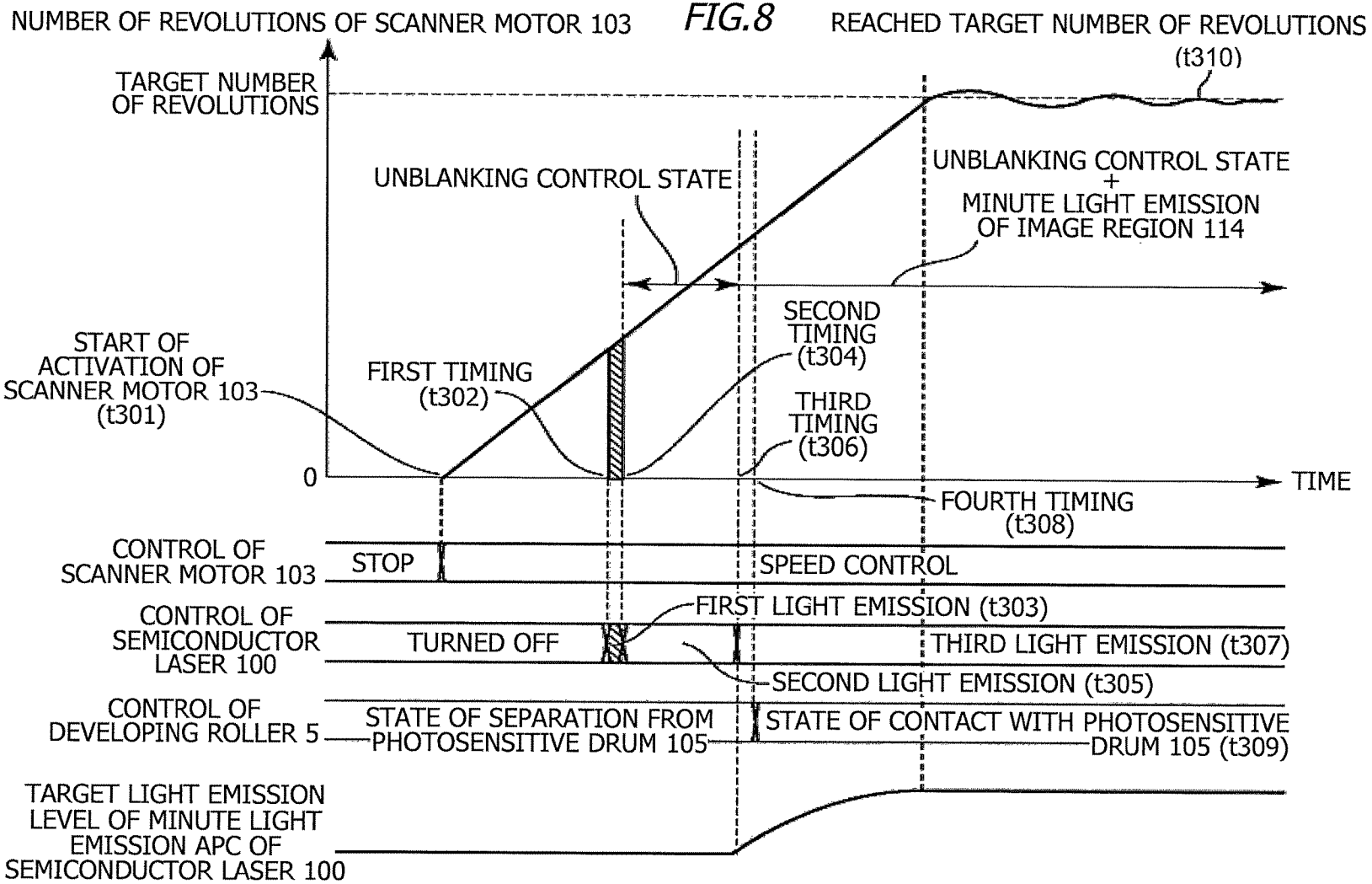
FIG. 8 is a characteristic diagram illustrating a change in the number of revolutions from start of activation of the scanner motor 103.

FIG. 8 is a characteristic diagram illustrating a change in the number of revolutions from start of activation of the scanner motor 103, in which an abscissa represents time and an ordinate represents the number of revolutions of the scanner motor 103. Control states of the scanner motor 103, the semiconductor laser 100, and the developing roller 5 which are controlled by the engine controller 110 are also illustrated. A difference from FIG. 5 is that the target light emission level of the minute light emission APC of the semiconductor laser 100 has been changed. Accordingly, the third timing and the fourth timing arrive earlier.

As described earlier in the first embodiment, the engine controller 110 estimates a current minute light emission energy amount when determining the third timing. In the present embodiment, minute light emission is performed even at a timing at which the number of revolutions of the scanner motor 103 is low and a scanning speed when performing minute light emission of the image region 114 is slow. In other words, the back contrast Vback as defined by the minute light emission energy amount is adjusted so as to fall within a prescribed threshold range and assumes a value at which positive fogging and inverse fogging of toner do not occur.

Specifically, the target light emission level of the minute light emission APC of the semiconductor laser 100 is set to a low level in advance, the back contrast Vback is set so as to fall within the prescribed threshold range, and the third timing is determined. In addition, after the third timing at which minute light emission to the image region 114 is started, the target light emission level of the minute light emission APC is gradually increased as the number of revolutions of the scanner motor 103 increases or, in other words, as the scanning speed when performing minute light emission of the image region 114 increases.

Accordingly, control is performed so that the back contrast Vback as defined by the minute light emission energy amount falls within the prescribed threshold range.

Specifically, as described above in the first embodiment, the engine controller 110 estimates the minute light emission energy based on a value obtained by dividing the current minute light emission level by the current scanning speed. In other words, the engine controller 110 performs control by increasing the minute light emission level as the scanning speed increases so that the minute light emission energy value falls within a prescribed threshold range. By changing a charging bias and a developing bias in combination with the control, the control of the back contrast Vback so as to fall within the prescribed threshold range can be performed with greater accuracy.

In this manner, after the third timing, control is performed so that minute light emission is performed on the image region 114 in advance before the developing roller 5 and the photosensitive drum 105 come into contact with each other. Performing minute light emission of the image region 114 on the photosensitive drum 105 in advance enables occurrences of positive fogging and inverse fogging of toner to be suppressed. Moreover, due to the minute light emission of the image region 114, the developing roller 5 can be brought into contact with the photosensitive drum 105 before activation of the scanner motor 103 is completed and a first print-out time (FPOT) can be shortened.

Third Embodiment

In the first embodiment described above, a method of performing the third light emission before the developing roller 5 and the photosensitive drum 105 come into contact with each other is explained. In the present embodiment, setting values (Md, Mbs, Mbe, Mvs, and Mve) which determine light emission regions in the second light emission and the third light emission are controlled so as to differ between before and after a transition is made from the second light emission to the third light emission. Accordingly, both avoidance of laser irradiation to the image region 114 in the second light emission and performance of laser irradiation to the image region 114 in the third light emission are achieved and irradiation of the photosensitive drum 105 by undesired stray light is suppressed.

As already described in the first embodiment, the engine controller 110 determines a setting value for determining a light emission region and performs unblanking control in the second light emission and the third light emission. In this case, since speed control of the scanner motor 103 is increasing the speed of the scanner motor 103 toward the target number of revolutions, there is a trend of BD periods gradually becoming shorter and a variation is created between adjacent BD periods in no small degree. Therefore, in the second light emission, the setting value which determines the light emission region is desirably set to a value at which irradiation of a laser beam to the image region 114 can be reliably avoided so as to suppress irradiation to the photosensitive drum 105. On the other hand, in the third light emission, the setting value which determines the light emission region is desirably set to a value at which irradiation of a laser beam to the image region 114 is reliably performed so as to prevent occurrences of positive fogging and inverse fogging of toner.

For example, values of Mvs and Mve in the second light emission are set wider than a light emission region corresponding to the image region 114 when the scanner motor 103 reaches the target number of revolutions. In other words, the value of Mvs is set smaller and the value of Mve is set larger. In addition, the values of Mvs and Mve in the third light emission are set narrower than a light emission region corresponding to the image region 114 during the second light emission. In other words, the value of Mvs is set larger and the value of Mve is set smaller. Generally, depending on restrictions in the configuration of the scanning apparatus 112, when light emission is performed at a prescribed location in the non-image region 115, a stray light phenomenon in which a laser beam is diffusely reflected inside the scanning apparatus 112 occurs and may possibly cause the image region 114 to be irradiated by a laser beam at a timing other than a desired timing and in a light amount other than a prescribed light amount. Therefore, when starting control for irradiating the image region 114 with a laser beam after the third light emission, control is desirably performed so as to target, to the maximum extent feasible, a region in which laser irradiation to the image region 114 is reliably performed. In this manner, a configuration is desirably adopted which enables the engine controller 110 to appropriately change setting values for determining light emission regions in the second light emission and the third light emission.

In this manner, after the third timing, control is performed so that minute light emission is performed on the image region 114 in advance before the developing roller 5 and the photosensitive drum 105 come into contact with each other. Performing minute light emission of the image region 114 on the photosensitive drum 105 in advance enables occurrences of positive fogging and inverse fogging of toner to be suppressed. Furthermore, by avoiding excessive laser irradiation to the photosensitive drum 105, deterioration of the photosensitive drum 105 can be suppressed.

Fourth Embodiment

Description of Image Forming Apparatus

Figure 9:
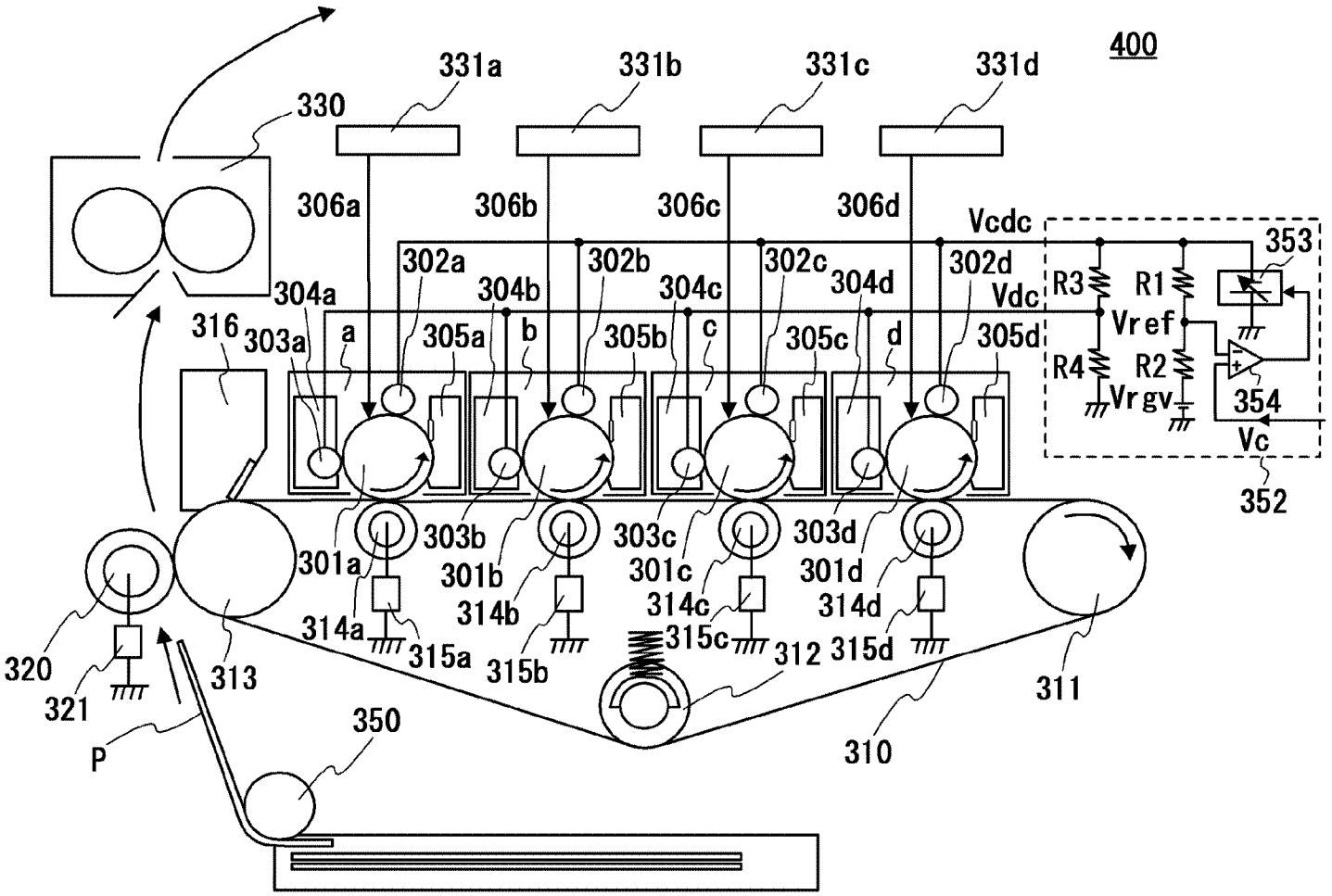
FIG. 9 is a schematic sectional view illustrating an image forming apparatus according to a fourth embodiment.

FIG. 9 is a schematic sectional view illustrating an image forming apparatus 400 according to the present embodiment. Hereinafter, a configuration and operations of the image forming apparatus 400 according to the present embodiment will be described with reference to FIG. 9.

The image forming apparatus 400 according to the present embodiment includes first, second, third, and fourth image forming portions (image forming stations) a, b, c, and d. The first, second, third, and fourth image forming portions a, b, c, and d respectively form an image of each of the colors of yellow (hereinafter, Y), magenta (hereinafter, M), cyan (hereinafter, C), and black (hereinafter, Bk).

Moreover, in the present embodiment, configurations of the first to fourth image forming portions a to d are substantially the same with the exception of differences in colors of toners (developers) used. Therefore, unless the image forming portions are to be distinguished from one another, the suffixes a, b, c, and d added to the reference numerals in the drawings to indicate which color is to be produced by which element will be omitted and the image forming portions will be collectively described.

In addition, each of the image forming portions a to d is provided with a storage member (not illustrated) for storing a cumulative rotating time of photosensitive drums 301*a* to 301*d* as information related to a lifetime of the photosensitive drum. Furthermore, each image forming station is replaceable with respect to an image forming apparatus main body. In addition, each image forming portion may at least include the photosensitive drum 301, and to what extent members are to be replaceably included in the image forming portion is not particularly limited.

Moreover, in the following description, descriptions of a unit of an exposure amount (μJ/cm$^2$), a unit of a light emission level (a light emission amount) (μJ/sec), a unit of speed (rotational speed or scanning speed) (cm/sec), and a unit of time (sec) may be omitted for the sake of brevity.

Hereinafter, operations of the first image forming portion a will be described as an example.

The first image forming portion a includes a photosensitive drum 301*a* as an image bearing member (a photosensitive member). The photosensitive drum 301*a* is rotationally driven at a prescribed peripheral velocity in a direction indicated by an arrow in FIG. 9 and is uniformly charged by the charging potential Vcdc applied to a charging roller 302*a*. Next, due to scanning by a laser beam 306*a* emitted from a scanner unit 331*a* as an irradiating portion) based on image data supplied from the outside, an image portion on a surface of the photosensitive drum 301*a* is exposed in an exposure amount Ep for image formation to form a latent image (an electrostatic latent image). In addition, the scanner unit 331*a* exposes a non-image portion in which a latent image is not formed on the surface of the photosensitive drum 301*a* by scanning by the laser beam 306*a* in an exposure amount Ebg for minute light emission. In this case, a relationship between the exposure amount Ep and the exposure amount Ebg is controlled so as to satisfy Ep>Ebg. The image portion is irradiated by light in the exposure amount Ep (a first light emission amount) from the scanner unit 331*a* to cause toner to adhere and to form a latent image. In addition, the non-image portion is irradiated by light in the exposure amount Ebg (a second light emission amount) from the scanner unit 331*a* to prevent adherence of toner.

In the image portion (the latent image) exposed in the exposure amount Ep, Y toner adheres due to the developing potential Vdc applied to a developing device 304*a* and is visualized. Since the non-image portion exposed in the exposure amount Ebg has a potential at which toner is less likely to adhere (a potential at which positive fogging and inverse fogging are less likely to occur), adherence of toner does not occur. The developing device 304*a* includes a developing roller 303*a*, and the developing device 304*a* and the developing roller 303*a* constitute a developing portion. In the present embodiment, the developing device 304*a* (the developing roller 303*a*) is provided so as to be able to come into contact with and separate from the photosensitive drum 301*a*. A configuration is adopted such that, in an image formation period, the photosensitive drum 301*a* and the developing device 304*a* can be brought into contact with each other to develop the latent image formed on the photosensitive drum 301*a*, and in a non-image formation period, the photosensitive drum 301*a* and the developing device 304*a* can be separated from each other.

A charging/developing high-voltage power supply 352 will now be described.

The charging/developing high-voltage power supply 352 is connected to each charging roller 302 and each developing roller 303 corresponding to each of a plurality of colors. In addition, the charging/developing high-voltage power supply 352 supplies the charging voltage Vcdc output from a transformer 353 to each charging roller 302 and supplies the developing voltage Vdc divided by two resistive elements R3 and R4 to each developing roller 303 (the developing device 304). Since the charging/developing high-voltage power supply 352 has a simplified power supply system, the voltages supplied to the respective rollers can be collectively adjusted while maintaining a prescribed relationship. On the other hand, independent adjustment is not able to be performed for each color. The resistive elements R3 and R4 may be constituted by any of a fixed resistor, a semi-fixed resistor, and a variable resistor. In addition, in the diagram, power supply voltage itself from the transformer 353 is directly input to each charging roller 302, and divided voltage obtained by dividing voltage output from the transformer 353 by a fixed dividing resistor is directly input to each developing roller 303. However, this is merely an example and a voltage input mode is not limited thereto as long as common voltage is input for charging and common voltage is input for developing.

In addition, in order to control the charging voltage Vcdc so as to be constant, negative voltage obtained by stepping down the charging voltage Vcdc according to expression 1 below is offset to voltage with positive polarity by reference voltage Vrgv and adopted as monitor voltage Vref, and feedback control is performed so that the monitor voltage Vref has a constant value.

$$R2/(R1+R2) \qquad \text{Expression 1}$$

Specifically, control voltage Vc set in advance is input to a positive terminal of an operational amplifier 354 and the monitor voltage Vref is input to a negative terminal of the operational amplifier 354. In addition, an output value of the operational amplifier 354 performs feedback control of a control/drive system of the transformer 353 so that the monitor voltage Vref equals the control voltage Vc. Accordingly, the charging voltage Vcdc output from the transformer 353 is controlled so as to assume a target value.

The intermediate transfer belt 310 is tautened by tautening members 311, 312, and 313 and is in contact with the photosensitive drum 301*a*. The intermediate transfer belt 310 is rotationally driven at the contact position in a same direction and at a same peripheral velocity as the photosensitive drum 301*a*. A Y toner image formed on the photosensitive drum 301*a* is transferred as follows. As the Y toner image passes a contact portion (a primary transfer portion) between the photosensitive drum 301*a* and the intermediate transfer belt 310, the Y toner image is transferred onto the intermediate transfer belt 310 by primary transfer voltage applied to a primary transfer roller 314*a* by a primary transfer high-voltage power supply 315*a* (primary transfer). Primary transfer residual toner remaining on the surface of the photosensitive drum 301*a* is cleaned and removed by a drum cleaning apparatus 305*a* that is a cleaning unit. In a similar manner, an M toner image of the second color, a C toner image of the third color, and a Bk toner image of the fourth color are formed and sequentially transferred onto the intermediate transfer belt 310 so as to overlap with each other to obtain a full-color image.

As the toner images of four colors on the intermediate transfer belt 310 pass a contact portion (a secondary transfer portion) between the intermediate transfer belt 310 and a secondary transfer roller 320, a secondary transfer high-voltage power supply 321 applies secondary transfer voltage to the secondary transfer roller 320. Accordingly, the toner images of the four colors on the intermediate transfer belt 310 are collectively transferred to a surface of a recording material P fed from a feeding roller 350. Subsequently, the recording material P bearing the toner images of the four colors is transported to a fixing unit 330, and by being subjected to heat and pressure in the fixing unit 330, the toners of the four colors are melted, mixed, and fixed to the recording material P. According to the operations described above, a full-color toner image is formed on a recording medium. In addition, secondary transfer residual toner that remains on the surface of the intermediate transfer belt 310 is cleaned and removed by an intermediate transfer belt cleaning apparatus 316.

Description of Sensitivity Characteristics of Photosensitive Drum

Figure 10:
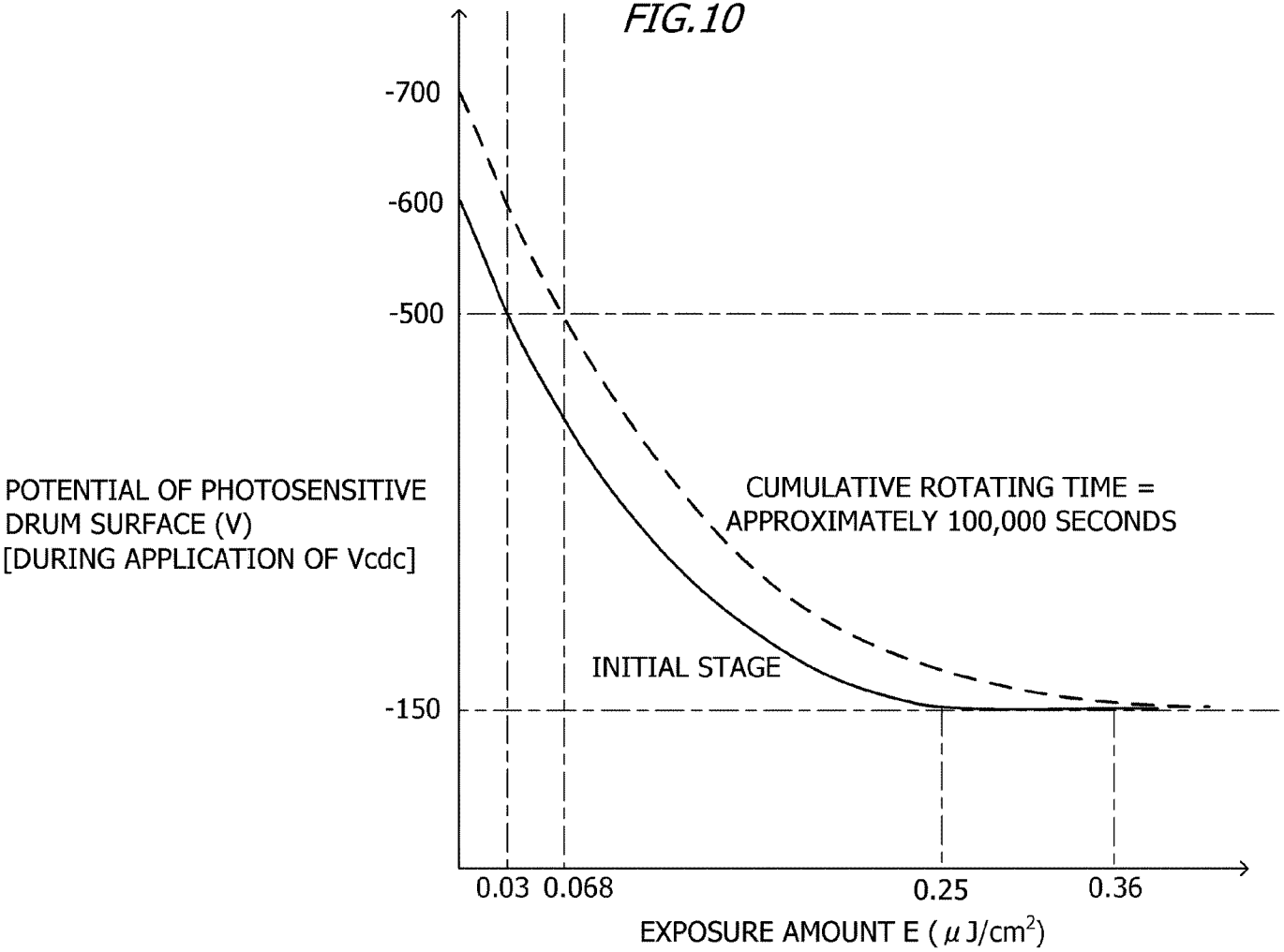
FIG. 10 is a diagram illustrating an example of an EV curve indicating sensitivity characteristics of a photosensitive drum according to the fourth embodiment.

FIG. 10 is a diagram illustrating an example of an EV curve representing sensitivity characteristics of the photosensitive drum 301, in which an abscissa represents an exposure amount E (μJ/cm$^2$) on the surface of the photosensitive drum and an ordinate represents potential (V) on the surface of the photosensitive drum.

The EV curve indicates potential on the surface of the photosensitive drum 301 when the photosensitive drum 301 after being charged to the charging voltage Vcdc is exposed by a laser beam so that an exposure amount on the surface of the photosensitive drum equals E. In addition, the EV curve indicates that a large potential attenuation is obtained by increasing the exposure amount E. Furthermore, a high potential portion indicates a large potential attenuation even when the exposure amount is small since the high potential portion is a strong electric field environment and recombination of charge carriers (electron-hole pairs) generated by exposure is unlikely to occur. On the other hand, in a low potential portion, since recombination of generated carriers are likely to occur, a phenomenon is observed in which potential attenuation is small even with respect to exposure in a large exposure amount. In addition, FIG. 10 respectively illustrates an EV curve of an initial stage of use of the photosensitive drum 301 and an EV curve at a stage after continuous use of the photosensitive drum 301. A dashed-line curve represents, for example, an EV curve when the cumulative rotating time of the photosensitive drum 301 is approximately 100,000 seconds, and EV curves differ depending on the cumulative rotating time (a durable state) of the photosensitive drum 301. Note that the sensitivity characteristics of the photosensitive drum 301 illustrated in FIG. 10 are merely examples and the applications of photosensitive drums 301 having various EV curves are envisaged in the present embodiment.

Figure 11A:
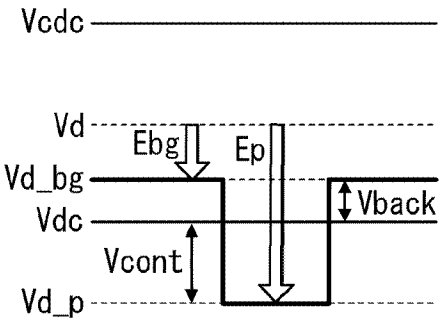
FIGS. 11A to 11C are diagrams for explaining relevance of potential when a cumulative rotating time of a photosensitive drum changes.
Figure 11B:
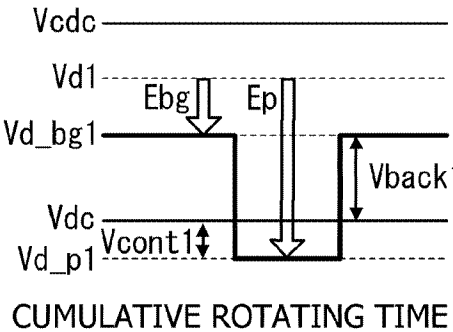
Figure 11C:
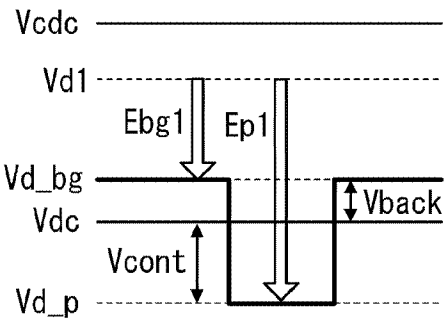

Relationship Between Exposure Amount and Cumulative Rotating Time of Photosensitive Drum FIGS. 11A to 11C are diagrams for explaining a relationship among a charging potential, a developing potential, and an exposure potential when a cumulative rotating time of the photosensitive drum 301 changes.

FIG. 11A is a diagram illustrating potentials of the surface of the photosensitive drum 301 in an initial stage of use of the photosensitive drum 301 when exposed in exposure amounts of Ep (μJ/cm$^2$) and Ebg (μJ/cm$^2$).

The photosensitive drum 301 is charged to a potential Vd by the charging potential Vcdc applied to the charging roller 302. The non-image portion of the surface of the photosensitive drum 301 is minutely exposed in the exposure amount Ebg due to scanning by the laser beam 306*a* of the scanner unit 331*a* and assumes a potential of Vd_bg. Meanwhile, the image portion of the surface of the photosensitive drum 301 is exposed in the exposure amount Ep due to scanning by the laser beam 306*a* of the scanner unit 331*a* and assumes a potential of Vd_p. In the image portion having assumed a potential of Vd_p, toner adheres due to a difference in potential (Vcont) between the developing potential Vdc applied to the developing device 304 and the potential Vd_p. Meanwhile, in the non-image portion having assumed a potential of Vd_bg, toner is less likely to adhere (positive fogging and inverse fogging are less likely to occur) due to a difference in potential (Vback) between the developing potential Vdc applied to the developing device 304 and the potential Vd_bg. In the present embodiment, the charging voltage Vcdc is approximately −1100 V, the developing voltage Vdc is approximately −350 V, the potential Vd is approximately −600 V to approximately −700 V, the potential Vd_bg is approximately −400 V, and the potential Vd_p is approximately −150 V.

FIG. 11B is a diagram illustrating potentials of the surface of the photosensitive drum 301 in a stage after the photosensitive drum 301 has been continuously used up to a cumulative rotating time of approximately 100,000 seconds when exposed in exposure amounts of Ep and Ebg.

Compared to the potentials in the photosensitive drum 301 in the initial stage of use described with reference to FIG. 11A, potentials Vd1, Vd_bg1, and Vd_p1 are stronger than potentials Vd, Vd_bg, and Vd_p. As a result, in the image portion, a difference in potential (Vcont1) between the developing potential Vdc applied to the developing device 304 and the potential Vd_p1 becomes smaller and toner is less likely to adhere (density decrease). In addition, in the non-image portion, a difference in potential (Vback1) between the developing potential Vdc applied to the developing device 304 and the potential Vd_bg1 becomes larger and toner is more likely to adhere (inverse fogging is more likely to occur). For example, there may be cases where, after the first to fourth image forming portions a to d are used to a certain degree, only the first image forming portion a is replaced with a new unit by a user. In such a case, when the first to fourth image forming portions a to d are exposed in the same exposure amounts Ep and Ebg, density decrease and inverse fogging may possibly occur in the second to fourth image forming portions b to d.

FIG. 11C is a diagram illustrating potentials of the surface of the photosensitive drum 301 in a stage after the photosensitive drum 301 has been continuously used up to a cumulative rotating time of approximately 100,000 seconds when exposed in exposure amounts of Ep1 and Ebg1.

Changing the exposure amounts Ep and Ebg to the exposure amounts Ep1 and Ebg1 enables potentials equivalent to the potentials in the photosensitive drum 301 in an initial stage of use to be set.

As described above, in each image forming portion, by determining the exposure amounts Ep and Ebg in accordance with the cumulative rotating time of the photosensitive drum 301, the potential of the surface of the photosensitive drum after exposure can be set to an equivalent level even when there is a difference in the cumulative rotating times of the respective photosensitive drums 301.

In each image forming portion, the exposure amount can be changed by changing a light emission level of the laser beam 306 of the scanner unit 331. The light emission levels corresponding to the exposure amount Ep and the exposure amount Ebg are Wp (μJ/sec) and Wbg (μJ/sec).

Description of Optical Scanning Apparatus

Figure 12:
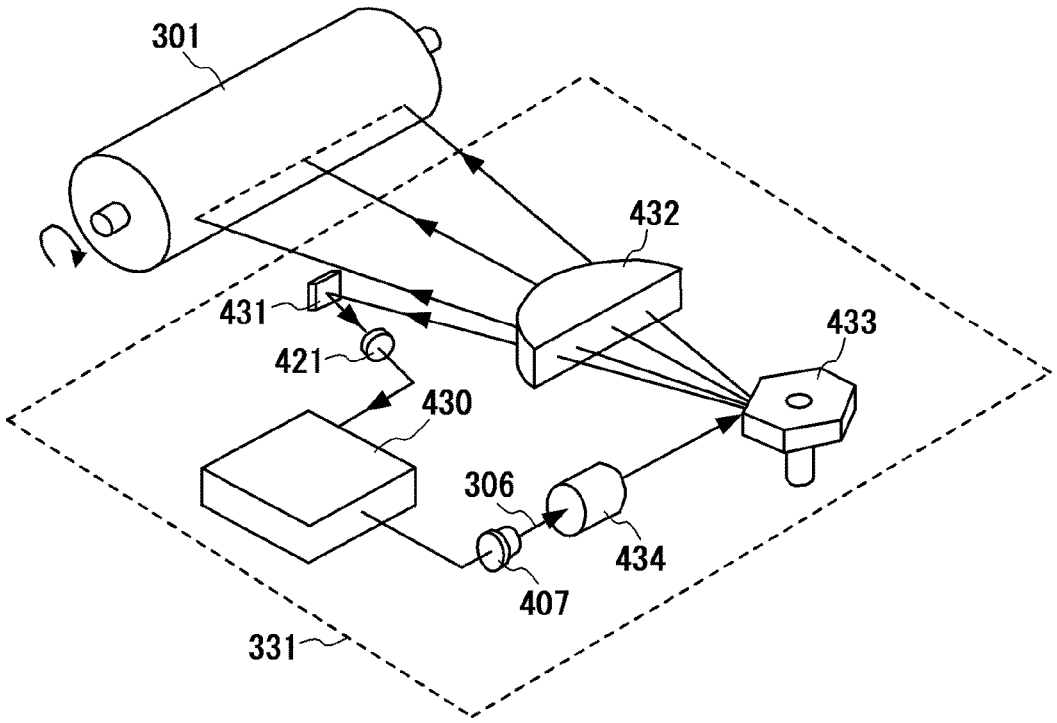
FIG. 12 is a diagram illustrating an external appearance of a scanner unit according to the fourth embodiment.

FIG. 12 is a diagram illustrating an external appearance of scanner units 331*a* to 331*d*.

When a laser drive system circuit 430 is actuated in accordance with a light emission level set by an engine controller 422 (refer to FIG. 13), a driving current flows through a laser diode 407 that is a light emitting element (a light source). In this case, the engine controller 422 constitutes a control portion, an acquiring portion, and a storage portion. The engine controller 422 will be described later. Note that the storage portion is not limited to being provided in the image forming apparatus and, alternatively, may be provided in an external apparatus separate from the image forming apparatus.

The laser diode 407 emits the laser beam 306 at an intensity level in accordance with the driving current. In addition, the laser beam 306 emitted by the laser diode 407 is subjected to beam shaping by a collimator lens 434, made into a parallel beam, reflected toward the photosensitive drum 301 by a polygonal mirror (a rotating mirror) 433, and scanned in a horizontal direction of the photosensitive drum 301. The scanned laser beam 306 is focused on the surface of the photosensitive drum 301 rotating in a direction of an arrow around a rotational axis and exposed in a dot shape by a fθ lens 432. Meanwhile, a reflective mirror 431 is provided so as to correspond to a scanning position on a side of one end of the photosensitive drum 301 and reflects a laser beam projected to a scan start position toward a BD (Beam Detect) synchronization detection sensor (hereinafter, a BD detection sensor) 421. A scan start timing of the laser beam is determined based on an output of the BD detection sensor 421.

Description of Laser Drive System Circuit (LD Driver)

Figure 13:
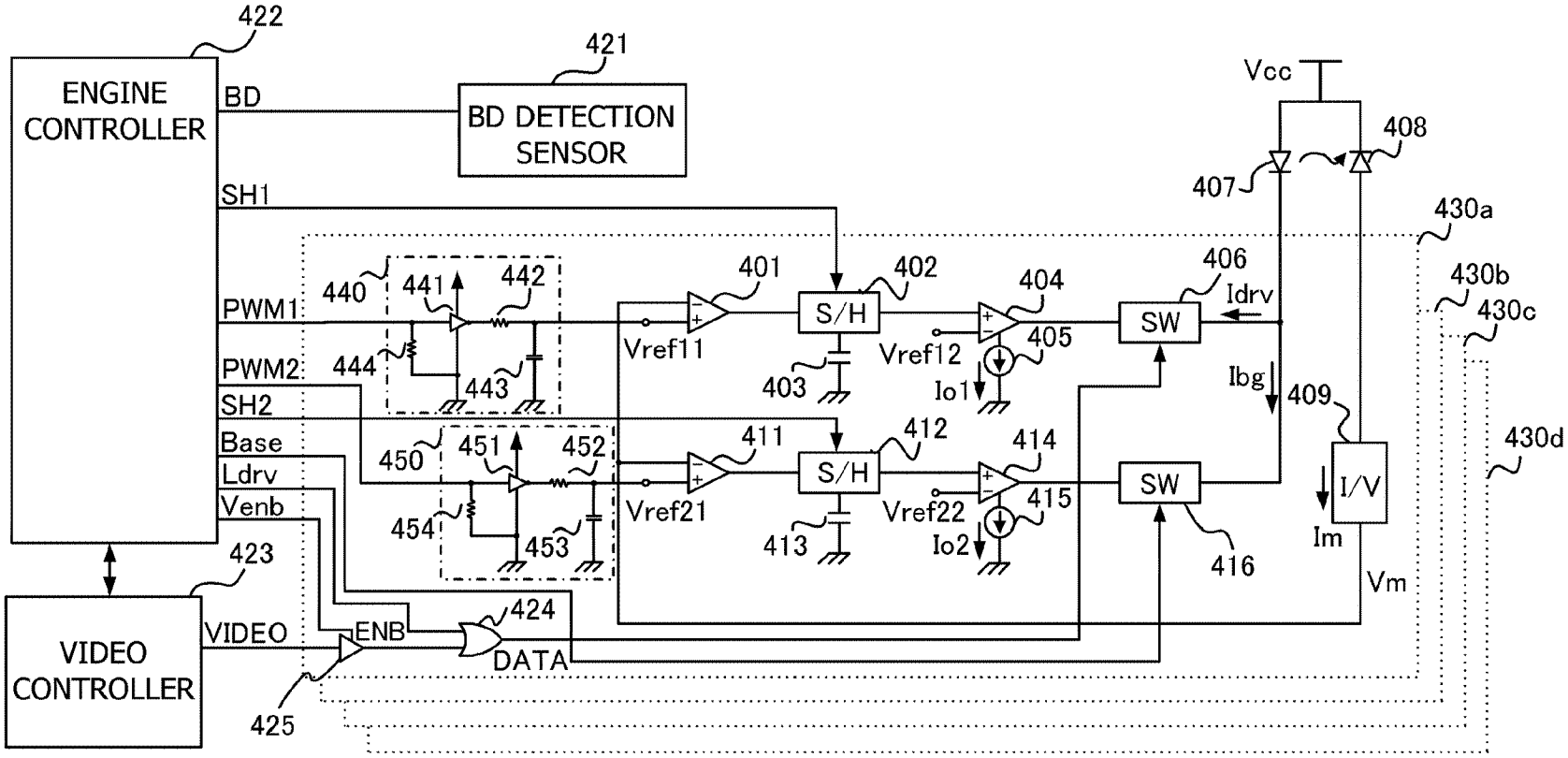
FIG. 13 is a circuit diagram of a circuit which automatically adjusts a light emission level of a laser diode according to the fourth embodiment.

FIG. 13 is a circuit diagram of the laser drive system circuit 430 which automatically adjusts a light emission level of the laser diode 407.

A portion enclosed by a frame of a dotted line 430*a* corresponds to the laser drive system circuit 430 illustrated in FIG. 12. In addition, configurations inside frames of dotted lines 430*b* to 430*d* are assumed to be similar to the configuration inside the frame of the dotted line 430*a*, and the configurations inside the frames of the dotted lines 430*a* to 430*d* correspond to laser drive system circuits 430 of the respective colors in a color image forming apparatus. While a configuration of the laser drive system circuit 430 of a specific color will be described below, it is assumed that the laser drive system circuits 430 of the other colors have similar configurations and redundant descriptions will be omitted.

The laser drive system circuit 430 includes PWM smoothing circuits 440 and 450, comparator circuits 401 and 411, sampling/holding circuits 402 and 412, and holding capacitors 403 and 413. In addition, the laser drive system circuit 430 includes current amplifier circuits 404 and 414, reference current sources (constant current circuits) 405 and 415, switching circuits 406 and 416, and a current-voltage conversion circuit 409. Furthermore, although a detailed description will be provided later, a portion denoted by reference numerals 401 to 406 corresponds to a first light intensity adjusting portion (a first current adjusting portion), and a portion denoted by reference numerals 411 to 416 corresponds to a second light intensity adjusting portion (a second current adjusting portion). Moreover, each of the light emission level for image formation (hereinafter, a first light emission level) and a light emission level for minute light emission (hereinafter, a second light emission level) to be described later can be independently controlled by a control portion (the first light intensity adjusting portion and the second light intensity adjusting portion), which adjusts the respective light emission amounts.

The engine controller 422 outputs a PWM signal PWM1 to the PWM smoothing circuit 440. The PWM smoothing circuit 440 is constituted by an inverter circuit 441, resistors 442 and 444, and a capacitor 443, and the inverter circuit 441 inverts the PWM signal PWM1. An output of the inverter circuit 441 charges the capacitor 443 via the resistor 442 and is smoothed by the capacitor 443 to become a voltage signal. In addition, the smoothed voltage signal is input to a terminal of the comparator circuit 401 as reference voltage Vref11. In this manner, the reference voltage Vref11 is determined by a signal pulse width of the PWM signal PWM1 and controlled by the engine controller 422.

In addition, the engine controller 422 outputs a PWM signal PWM2 to the PWM smoothing circuit 450. The PWM smoothing circuit 450 is constituted by an inverter circuit 451, resistors 452 and 454, and a capacitor 453, and the inverter circuit 451 inverts the PWM signal PWM2. An output of the inverter circuit 451 charges the capacitor 453 via the resistor 452 and is smoothed by the capacitor 453 to become a voltage signal. In addition, the smoothed voltage signal is input to a terminal of the comparator circuit 411 as reference voltage Vref21. In this manner, the reference voltage Vref21 is determined by a signal pulse width of the PWM signal PWM2 and controlled by the engine controller 422. Both the reference voltages Vref11 and Vref21 may be output directly without instructions of a PWM signal from the engine controller 422.

A Ldrv signal of the engine controller 422 and a VIDEO signal from a video controller 423 are input to an input terminal of an OR circuit 424, and a Data signal is output from the OR circuit 424 to the switching circuit 406 to be described later. In this case, the VIDEO signal is a signal based on image data sent from an externally-connected reader scanner or an external device such as a host computer. More specifically, for example, the VIDEO signal is a signal driven by image data that is an 8-bit (=256-gradation) multi-valued signal (0 to 255) for determining a laser emission time. If a pulse width when image data is 0 is denoted by PWmin and a pulse width when image data is 255 is denoted by PWmax, a pulse width PWn when the image data is n is generated in proportion to a gradation value between PWmin and PWmax and is expressed by expression 2 below.

$$PWn=(n\times(PW\max-PW\min)/255)+PW\min \qquad \text{Expression 2}$$

A case where the image data for controlling the laser diode 407 is 8 bits (=256 gradations) is simply an example and, for example, the image data may be a 4-bit (=16-gradation) or 2-bit (=4-gradation) multi-valued signal after halftone processing. Alternatively, the image data after halftone processing may be a binarized signal.

The VIDEO signal output from the video controller 423 is input to a buffer 425 with an enable terminal (ENB), and an output of the buffer 425 is input to the OR circuit 424. In this case, the enable terminal is connected to a signal line to which a Venb signal from the engine controller 422 is output. In addition, the engine controller 422 outputs an SH1 signal, an SH2 signal, a Base signal, an Ldrv signal, and the Venb signal to be described later. The Venb signal is for performing a mask process on the Data signal based on the VIDEO signal, and by placing the Venb signal in a disabled state (off state), a timing of an image mask region (an image mask period) can be created.

First reference voltage Vref11 and second reference voltage Vref21 are respectively input to positive electrode terminals of the comparator circuits 401 and 411, and outputs of the comparator circuits 401 and 411 are respectively input to the sampling/holding circuits 402 and 412. The reference voltage Vref11 is set as target voltage for causing the laser diode 407 to emit light at the first light emission level. In addition, the reference voltage Vref21 is set as target voltage of the second light emission level. The holding capacitors 403 and 413 are respectively connected to the sampling/holding circuits 402 and 412. Outputs of the sampling/holding circuits 402 and 412 are respectively input to positive electrode terminals of the current amplifier circuits 404 and 414.

The reference current sources 405 and 415 are respectively connected to the current amplifier circuits 404 and 414, and outputs of the current amplifier circuits 404 and 414 are input to the switching circuits 406 and 416. Third reference voltage Vref12 and fourth reference voltage Vref22 are respectively input to negative electrode terminals of the current amplifier circuits 404 and 414. In this case, a current Io1 (a first driving current) is determined in accordance with a difference between output voltage of the sampling/holding circuit 402 and the reference voltage Vref12 as described earlier. In addition, a current Io2 (a second driving current) is determined in accordance with a difference between output voltage of the sampling/holding circuit 412 and the reference voltage Vref22. In other words, Vref12 and Vref22 are voltage settings for determining currents.

The switching circuit 406 is turned on and off by the Data signal that is a pulse-modulated data signal. The switching circuit 416 is turned on and off by an input signal Base. Output terminals of the switching circuits 406 and 416 are connected to a cathode of the laser diode 407 and supply driving currents Idrv and Ibg. An anode of the laser diode 407 is connected to a power supply Vcc. A cathode of a photodiode 408 (hereinafter, PD 408) which monitors a light amount of the laser diode 407 is connected to the power supply Vcc, and an anode of the PD 408 is connected to the current-voltage conversion circuit 409 and passes a monitor current Im through the current-voltage conversion circuit 409. Accordingly, the current-voltage conversion circuit 409 converts the monitor current Im into monitor voltage Vm. The monitor voltage Vm is input to negative electrode terminals of the comparator circuits 401 and 411 on a non-feedback basis.

Note that, while the engine controller 422 and the video controller 423 are separately illustrated in FIG. 13, this mode is not restrictive. For example, a part of or all of the engine controller 422 and the video controller 423 may be constructed by a same controller. Similarly, a part of or all of the laser drive system circuit 430 enclosed by a dotted-line frame in the drawing may be incorporated into the engine controller 422.

As described above, by setting the PWM signal PWM1 and the PWM signal PWM2 with respect to the laser drive system circuit 430, the engine controller 422 can control the driving current I flowing through the laser diode 407 (a light emission level W of the laser diode 407). The term light emission level W as used herein refers to a light amount emitted per unit time by the laser diode 407 for exposing the surface of the photosensitive drum 301 in an exposure amount E. Hereinafter, the light emission level when a driving current In flows through the laser diode 407 will be denoted by Wn.

Description of Automatic Adjustment of Light Emission Level W

Next, automatic adjustment of the light emission level W of the laser diode 407 (a driving current I in the laser drive system circuit 430) will be described. First, automatic adjustment of a light emission level Wdrv will be described. According to an instruction of the SH2 signal, the engine controller 422 sets the sampling/holding circuit 412 to a hold state (a non-sampling period) and, at the same time, turns the switching circuit 416 off with the input signal Base. In addition, according to an instruction of the SH1 signal, the engine controller 422 sets the sampling/holding circuit 402 to a sampling state and switches on the switching circuit 406 with the Data signal. More specifically, at this point, the engine controller 422 controls the Ldrv signal and sets the Data signal so as to create a light-emitting state of the laser diode 407.

In this state, when the laser diode 407 enters a full-surface light-emitting state (lighting-maintained state), the PD 408 monitors a light emission intensity of the laser diode 407 and causes a monitor current Im1 proportional to the light emission intensity to flow. In addition, by causing the monitor current Im1 to flow through the current-voltage conversion circuit 409, the current-voltage conversion circuit 409 converts the monitor current Im1 into monitor voltage Vm1. Furthermore, the current amplifier circuit 404 controls the driving current Idrv based on Io1 that flows through the reference current source 405 so that the monitor voltage Vm1 matches the first reference voltage Vref11 that is a target value.

Moreover, in an image formation period, the sampling/holding circuit 402 is in a hold period (in a non-sampling period), the switching circuit 406 is turned on/off in accordance with the Data signal, and pulse width modulation is applied to the driving current Idrv.

Next, automatic adjustment of the light emission level Wbg of the laser diode 407 (a driving current Ibg in the laser drive system circuit 430) will be described. According to an instruction of the SH1 signal, the engine controller 422 sets the sampling/holding circuit 402 to a hold state (a non-sampling period) and, at the same time, turns the switching circuit 406 off with the Data signal. In relation to the Data signal, the engine controller 422 sets the Venb signal connected to the enable terminal of the buffer 425 with an enable terminal to a disabled state, controls the Ldrv signal, and sets the Data signal to an off state. In addition, according to an instruction of the SH2 signal, the engine controller 422 sets the sampling/holding circuit 412 to a sampling state, switches on the switching circuit 416 with the input signal Base, and sets the laser diode 407 to a light-emitting state.

In this state, when the laser diode 407 enters a full-surface light-emitting state (lighting-maintained state), the PD 408 monitors a light emission intensity of the laser diode 407 and generates a monitor current Im2 (Im1>Im2) which is proportional to the light emission intensity. In addition, by causing a monitor current Im2 to flow through the current-voltage conversion circuit 409, the current-voltage conversion circuit 409 converts the monitor current Im2 into monitor voltage Vm2. Furthermore, the current amplifier circuit 414 controls the driving current Ibg based on the current Io2 that flows through the reference current source 415 so that the monitor voltage Vm2 matches the second reference voltage Vref21 that is a target value.

Moreover, in an image formation period, the sampling/holding circuit 412 is in a hold period (in a non-sampling period) and the full-surface light-emitting state is maintained.

Description of Second Light Emission Level

The second light emission level (the second light emission amount) signifies a level of light emission intensity which prevents a developer such as toner from being charged and adhering to the photosensitive drum 301 (prevents from becoming visible) and which makes a toner fogging state preferable. In addition, the second light emission level is the light emission level Wbg when a driving current Ibg flows through the laser diode 407. In other words, the second light emission level Wbg is a light emission amount of the laser diode 407 for exposing a non-image portion of the surface of the photosensitive drum 301 in the exposure amount Ebg to attain a charging potential of Vd_bg. Furthermore, the second light emission level Wbg is set to a light emission intensity at which the laser diode 407 emits a laser beam. Hypothetically, when the second light emission level Wbg is a light emission intensity that is less than sufficient for laser emission, a wavelength distribution of a spectrum spreads widely and becomes a wavelength distribution that is wider with respect to a rated wavelength of the laser. Therefore, sensitivity of the photosensitive drum is disrupted and surface potential thereof becomes unstable. For this reason, the second light emission level Wbg is preferably set to a light emission intensity at which the laser diode 407 emits a laser beam.

Description of First Light Emission Level

On the other hand, the first light emission level (the first light emission amount) signifies a level of light emission intensity at which charging and adherence of a developer to the photosensitive drum 301 reaches a saturated state. In addition, the first light emission level is the light emission level Wp when a driving current Ibg+Idrv flows through the laser diode 407. In other words, the first light emission level Wp is a light emission amount of the laser diode 407 for exposing an image portion of the surface of the photosensitive drum 301 in the exposure amount Ep to attain a charging potential of Vd_p.

When causing the laser diode 407 to emit light at the first light emission level Wp, circuits illustrated in FIG. 13 are operated as follows. The engine controller 422 sets the sampling/holding circuit 412 to a hold period, turns on the switching circuit 416, sets the sampling/holding circuit 402 to a hold period, and turns on the switching circuit 406. Accordingly, the driving current Idrv+Ibg is supplied. In addition, the driving current Ibg can be supplied (can be set to the second light emission level Wbg) in an off state of the switching circuit 406.

The first light emission level Wp is a light emission intensity obtained by superimposing a PWM light emission level Wdrv due to pulse width modulation on the second light emission level Wbg. A detailed description will be given below. When the SH2 and SH1 signals are set to the hold period, the Base signal is switched on, and the engine controller 422 sets the Venb signal to an enabled state, the switching circuit 406 is turned on/off with the Data signal (VIDEO signal). Accordingly, light can be emitted at two levels when the driving current is between Ibg and Idrv+Ibg or, in other words, when the light emission intensity is between Wbg and Wp (Wdrv+Wbg).

By operating the circuits illustrated in FIG. 13 in this manner, due to the Data signal based on the VIDEO signal sent from the video controller 423, the engine controller 422 enables light to be emitted as follows and can have two light emission levels. Specifically, the engine controller 422 enables light emission at the first light emission level Wp and light emission at the second light emission level Wbg in a laser emission region.

Description of Functional Block Diagram

Figure 14:
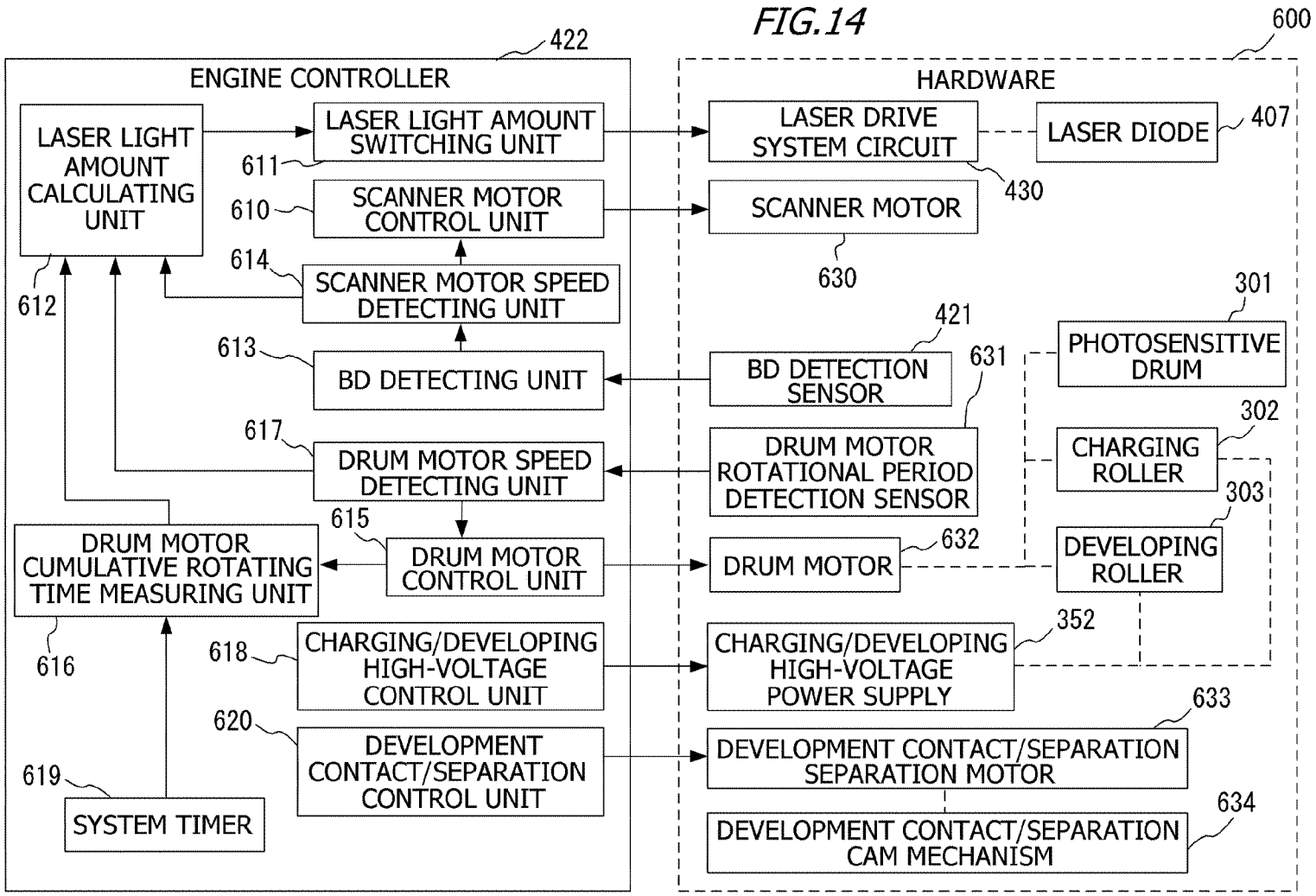
FIG. 14 is a diagram illustrating functional blocks and hardware related to an engine controller.

FIG. 14 is a diagram illustrating functional blocks and hardware 600 related to the engine controller 422.

Each of a scanner motor control unit 610, a laser light amount switching unit 611, a laser light amount calculating unit 612, a BD detecting unit 613, a scanner motor speed detecting unit 614, and a drum motor control unit 615 represents a functional block. In addition, each of a drum motor cumulative rotating time measuring unit 616, a drum motor speed detecting unit 617, a charging/developing high-voltage control unit 618, a system timer 619, and a development contact/separation control unit 620 also represents a functional block. Meanwhile, each of a scanner motor 630, the laser drive system circuit 430, the laser diode 407, the BD detection sensor 421, a drum motor 632, the photosensitive drum 301, the charging roller 302, and the developing roller 303 represents a piece of hardware. In addition, each of a drum motor rotational period detection sensor 631, the charging/developing high-voltage power supply 352, a development contact/separation motor 633, and a development contact/separation cam mechanism 634 also represents a piece of hardware. Hereinafter, each component will be described in detail.

The charging/developing high-voltage control unit 618 controls the charging/developing high-voltage power supply 352 to apply charging voltage to the charging roller 302 and apply developing voltage to the developing roller 303.

By controlling the development contact/separation motor 633, the development contact/separation control unit 620 drives the development contact/separation cam mechanism 634 to execute a development contact/separation operation in which a contact relationship between the photosensitive drum 301*a* and the developing device 304*a* is shifted to a separation state or a contact state.

The drum motor control unit 615 controls the drum motor 632 based on information from the drum motor rotational period detection sensor 631. Specifically, first, the drum motor speed detecting unit 617 detects a rotational speed of the drum motor 632 based on information acquired from the drum motor rotational period detection sensor 631. Subsequently, based on the rotational speed of the drum motor 632 detected by the drum motor speed detecting unit 617, the drum motor control unit 615 performs control so that the rotational speed of the drum motor 632 stabilizes at a target speed (a target rotational speed, a rotational speed in an image formation period). The drum motor cumulative rotating time measuring unit 616 measures a cumulative rotating time of the drum motor 632 using the drum motor control unit 615 and the system timer 619. As the drum motor 632 rotates, the photosensitive drum 301, the charging roller 302, and the developing roller 303 connected thereto also rotate.

The scanner motor control unit 610 controls, based on information from the BD detection sensor 421, the scanner motor 630 which rotationally drives the polygonal mirror 433. Specifically, the BD detecting unit 613 detects a BD based on information acquired from the BD detection sensor 421, and the scanner motor speed detecting unit 614 detects a rotational speed of the scanner motor 630 based on the BD detected by the BD detecting unit 613. Based on the rotational speed of the scanner motor 630 detected by the scanner motor speed detecting unit 614, the scanner motor control unit 610 performs control so that the rotational speed of the scanner motor 630 stabilizes at a target speed (a target rotational speed, a rotational speed in an image formation period).

Next, the laser light amount calculating unit 612 calculates a laser light amount based on the cumulative rotating time of the drum motor 632, the rotational speed of the scanner motor 630, and the rotational speed of the drum motor 632. In this case, the cumulative rotating time of the drum motor 632 is measured by the drum motor cumulative rotating time measuring unit 616. In addition, the rotational speed of the scanner motor 630 is detected by the scanner motor speed detecting unit 614. Furthermore, the rotational speed of the drum motor 632 is detected by the drum motor speed detecting unit 617.

Subsequently, the laser light amount switching unit 611 sets the laser light amount calculated by the laser light amount calculating unit 612 to the laser drive system circuit 430 and the laser diode 407 emits light. In this case, the rotational speed of the scanner motor 630 corresponds to the rotational speed of the polygonal mirror 433 and the rotational speed of the drum motor 632 corresponds to the rotational speed of the photosensitive drum 301.

Relationship Between Exposure Amount and Scanning Speed of Scanner Unit

Figure 15A:
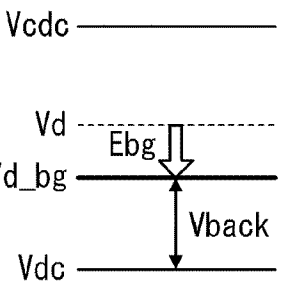
FIGS. 15A to 15C are diagrams for explaining relevance of potential when a rotational speed of a scanner unit changes.
Figure 15B:
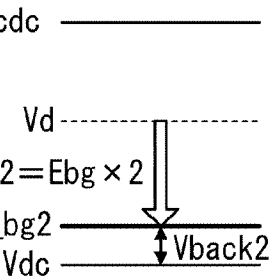
Figure 15C:
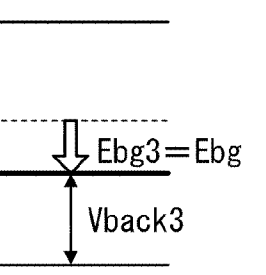

FIGS. 15A to 15C are diagrams for explaining a relationship among charging potential, developing potential, and exposure potential when the rotational speed of the scanner unit 331 changes.

FIG. 15A is a diagram illustrating a potential of the surface of a brand-new photosensitive drum 301 rotating at a speed Vy when, with respect to the surface of the photosensitive drum 301, the scanner unit 331 during start-up performs a scan at a speed Vx in a horizontal direction of the photosensitive drum 301 and emits light at the second light emission level Wbg. In the following description, the speed Vx may be referred to as a scanning speed of the scanner unit 331. In this case, the speed Vx corresponds to information related to the rotational speed of the polygonal mirror 433 (the scanner motor 630). In addition, the speed Vy corresponds to information related to the rotational speed of the photosensitive drum 301 (the drum motor 632). The charging potential Vd is attenuated to a charging potential Vd_bg by laser emission at a minute light emission level Ebg.

FIG. 15B is a diagram illustrating a potential of the surface of the photosensitive drum 301 when the scanning speed of the scanner unit 331 is set to Vx/2. The charging potential Vd is attenuated to a charging potential Vd_bg2 by laser emission at a minute light emission level Ebg2, which is Ebg×2. FIGS. 15A and 15B illustrate that, by reducing the scanning speed of the scanner unit 331 by half, the exposure amount Ebg per unit area of the surface of the photosensitive drum 301 is doubled and values of Vback and Vback2 differ from each other (the likelihood of an occurrence of fogging increases).

FIG. 15C is a diagram illustrating a potential of the surface of the photosensitive drum 301 when the scanning speed of the scanner unit 331 is set to Vx/2 and the second light emission level is set to Wbg/2. The charging potential Vd is attenuated to a charging potential Vd_bg3 by laser emission at a minute light emission level Ebg3, which is equal to Ebg. By changing the second light emission level in accordance with the scanning speed of the scanner unit 331 in this manner, values of Vback and Vback3 are similar and a potential at which fogging is less likely to occur can be attained.

A correspondence relationship among the exposure amount Ebg, the scanning speed of the scanner unit 331, and the second light emission level Wbg/2 described with reference to FIGS. 15A to 15C will now be described using mathematical expressions.

Expression 3 is an expression for calculating the exposure amount Ebg per unit area of the surface of the photosensitive drum 301 rotating at a speed Vy when, with respect to the surface of the photosensitive drum 301, the scanner unit 331 performs a scan at a scanning speed Vx and exposes the surface for a time T at the second light emission level Wbg.

$$Ebg=(T\times Wbg)/((T\times Vx)\times(T\times Vy)) \quad \text{Expression 3}$$

An exposure amount Ebg2 per unit area of the surface of the photosensitive drum 301 rotating at a speed Vy when, with respect to the surface of the photosensitive drum 301, the scanner unit 331 performs a scan at a scanning speed Vx/2 and exposes the surface for a time T at the second light emission level Wbg can be calculated as expression 4 below. Expression 4 indicates that the exposure amount is twice that of Ebg.

$$\begin{aligned} Ebg2&=(T\times Wbg)/((T\times Vx/2)\times(T\times Vy)) \\ &=2\times(T\times Wbg)/((T\times Vx)\times(T\times Vy)) \\ &=2\times Ebg \end{aligned} \quad \text{Expression 4}$$

An exposure amount Ebg3 per unit area of the surface of the photosensitive drum 301 rotating at a speed Vy when, with respect to the surface of the photosensitive drum 301, the scanner unit 331 performs a scan at a scanning speed Vx/2 and exposes the surface for a time T at the second light emission level Wbg/2 can be calculated as expression 5 below. Expression 5 indicates that the exposure amount is equal to that of Ebg.

$$\begin{aligned} Ebg3&=(T\times Wbg/2)/((T\times Vx/2)\times(T\times Vy)) \\ &=(T\times Wbg)/((T\times Vx)\times(T\times Vy)) \\ &=Ebg \end{aligned} \quad \text{Expression 5}$$

In other words, in a state where the scanner motor 630 reaches its target speed and the scanning speed of the scanner unit 331 is stable, the exposure amount can be adjusted to Ebg by emitting light at the second light emission level Wbg. However, in a state where the scanning speed of the scanner unit 331 is unstable such as during start-up of the scanner motor 630, it is difficult to maintain a constant exposure amount when light is emitted at the second light emission level Wbg. In consideration thereof, in a state where the scanning speed of the scanner unit 331 is unstable, light is preferably emitted at the second light emission level in accordance with the scanning speed of the scanner unit 331.

Preprocessing Sequence of Image Forming Operation

Hereinafter, an example of processing performed prior to an image forming operation (hereinafter, a preprocessing sequence of an image forming operation) will be described with reference to FIGS. 16A and 16B.

In the preprocessing sequence of an image forming operation, the engine controller 422 acquires information related to the speed Vy of the surface of the photosensitive drum 301. As information related to the speed Vy, the engine controller 422 detects a rotational speed of the drum motor 632 with the drum motor speed detecting unit 617. In addition, the engine controller 422 acquires information related to the scanning speed Vx of the scanner unit 331. As information related to the scanning speed Vx, the engine controller 422 detects a rotational speed of the scanner motor 630 with the scanner motor speed detecting unit 614.

The engine controller 422 performs the preprocessing sequence of an image forming operation using such information. A detailed description will be provided below.

Figure 16:
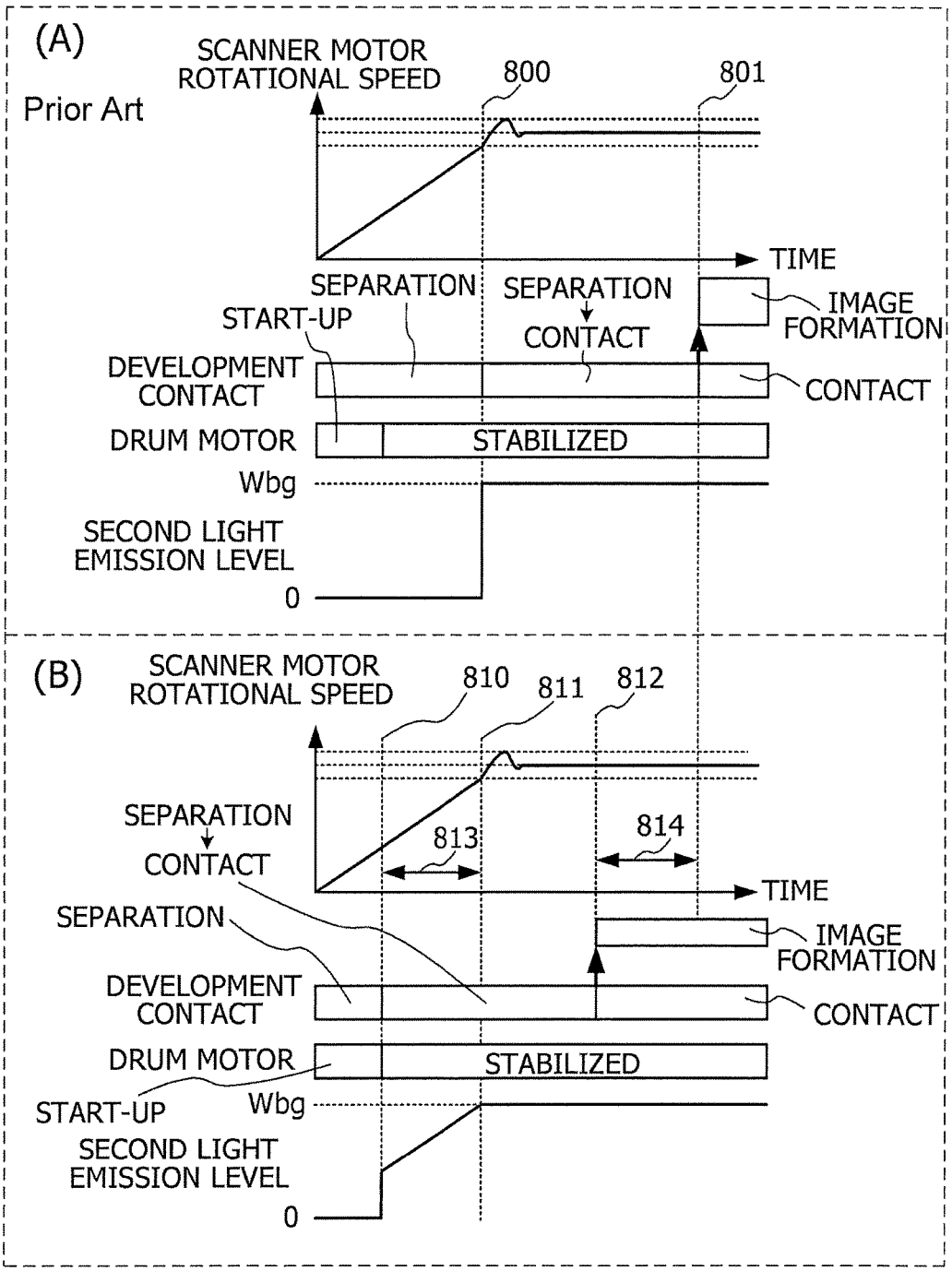
FIG. 16 is diagram illustrating an example of a preprocessing sequence of an image forming operation.

FIG. 16 is diagram illustrating an example of the preprocessing sequence of an image forming operation, in which (A) of FIG. 16 illustrates a comparative example and (B) of FIG. 16 illustrates the present embodiment. Note that, for the sake of brevity, the comparative example will also be described using a configuration similar to that of the present embodiment.

First, the preprocessing sequence of an image forming operation according to the comparative example illustrated in (A) of FIG. 16 will be described. Prior to the start of the image forming operation, the engine controller 422 activates and starts up the drum motor 632 and the scanner motor 630. When the rotational speed of the scanner motor 630 reaches within a certain range of a target speed (800), laser emission is started at the second light emission level Wbg and, at the same time, a development contact operation is started in which the contact relationship between the photosensitive drum 301 and the developing device 304 is shifted from the separation state to the contact state. Once the development contact operation is completed and the photosensitive drum 301 and the developing device 304 are in the contact state (801), image formation is started.

In the comparative example, since it is difficult to keep the exposure amount on the surface of the photosensitive drum constant during start-up of the scanner motor 630, the development contact operation is caused to wait until the rotational speed of the scanner motor 630 reaches within a certain range of the target speed. Therefore, the start timing of image formation also ends up being delayed and there is a concern that a first print-out time becomes longer.

In contrast, a feature of the present embodiment is that laser emission is performed during the start-up of the scanner motor 630 at the second light emission level Wbg having been adjusted in accordance with the rotational speed of the scanner motor 630 to keep the exposure amount Ebg of the surface of the photosensitive drum constant. Hereinafter, a method thereof will be described.

An exposure amount Ebg_c per unit area of the surface of the photosensitive drum 301 rotating at a speed Vy when, with respect to the surface of the photosensitive drum 301, the scanner unit 331 rotates at a scanning speed Vx_c and exposes the surface for a time T at the second light emission level Wbg_c can be calculated as expression 6 below.

$$Ebg_c=(T\times Wbg_c)/((T\times Vx_c)\times(T\times Vy)) \quad \text{Expression 6}$$

Even during the start-up of the scanner motor 630, the second light emission level Wbg for keeping the exposure amount Ebg of the photosensitive drum surface constant can be calculated as expressed by expression 7. Therefore, a relationship defined by expression 7 indicates that the exposure amount can be set equal by determining the second light emission level in accordance with a speed ratio between the target speed and the rotational speed during start-up of the scanner motor 630. In this case, while the photosensitive drum 301 is rotating at the speed Vy, this is a state where the drum motor 632 has reached the target speed and the rotational speed of the drum motor 632 has stabilized.

The engine controller 422 stores expression 7 or a correspondence relationship between the rotational speed of the drum motor 632 and the scanning speed of the scanner unit 331, and the second light emission level, as obtained from expression 7. Accordingly, in the start-up period of the scanner motor 630 in a state where the rotational speed of the drum motor 632 has stabilized, the engine controller 422 is capable of determining an optimum second light emission level in accordance with the scanning speed of the scanner unit 331. Note that, while the second light emission level is determined in accordance with the speed ratio between the target speed and the rotational speed of the scanner motor 630 in expression 7, favorably, the second light emission level is determined by further taking the cumulative rotating time of the photosensitive drum 301 into consideration.

$$Ebg_c=Ebg$$

$$(T\times Wbg_c)/((T\times Vx_c)\times(T\times Vy))=(T\times Wbg)/((T\times Vx)\times(T\times Vy))$$

$$Wbg_c=Wbg\times Vx_c/Vx \quad \text{Expression 7}$$

Hereinafter, an example of the preprocessing sequence of an image forming operation according to the present embodiment will be described with reference to (B) of FIG. 16.

Prior to the start of the image forming operation, the engine controller 422 activates the drum motor 632 and the scanner motor 630. Light is not emitted from the scanner unit 331*a* until the rotational speed of the drum motor 632 stabilizes. Once the drum motor 632 reaches the target speed and the rotational speed of the drum motor 632 stabilizes (810), the second light emission level is determined based on the relationship defined by expression 7 from the rotational speed of the scanner motor 630. Subsequently, laser emission with respect to the photosensitive drum surface is started at the determined second light emission level and, at the same time, a development contact operation is started. A relationship between a start timing of laser emission and a start timing of a development contact operation may be such that the surface of the photosensitive drum 301 is irradiated due to laser emission when the development contact operation is started so as to prevent an occurrence of fogging toner.

In the start-up period (a section denoted by reference numeral 813) of the scanner motor 630, the engine controller 422 switches to the second light emission level in accordance with the rotational speed of the scanner motor 630 based on the relationship defined by expression 7. As illustrated in (B) of FIG. 16, during the start-up of the scanner motor 630 according to the present embodiment, the higher the rotational speed of the scanner motor 630, the higher the second light emission level. When the rotational speed of the scanner motor 630 reaches within a certain range of the target speed (811), the second light emission level becomes Wbg. The engine controller 422 starts image formation once the development contact operation is completed and the photosensitive drum 301 and the developing device 304 are in the contact state (812).

Accordingly, even during start-up of the scanner motor 630, the potential of the photosensitive drum surface can be placed in a state where toner fogging does not occur.

In addition, in the present embodiment illustrated in (B) of FIG. 16, a start timing of the development contact operation can be set earlier than in the comparative example illustrated in (A) of FIG. 16 by an amount denoted by reference numeral 814. As a result, a timing at which image formation is started can also be set earlier and a first print-out time can be shortened.

Description of Flow Chart

Figure 17:
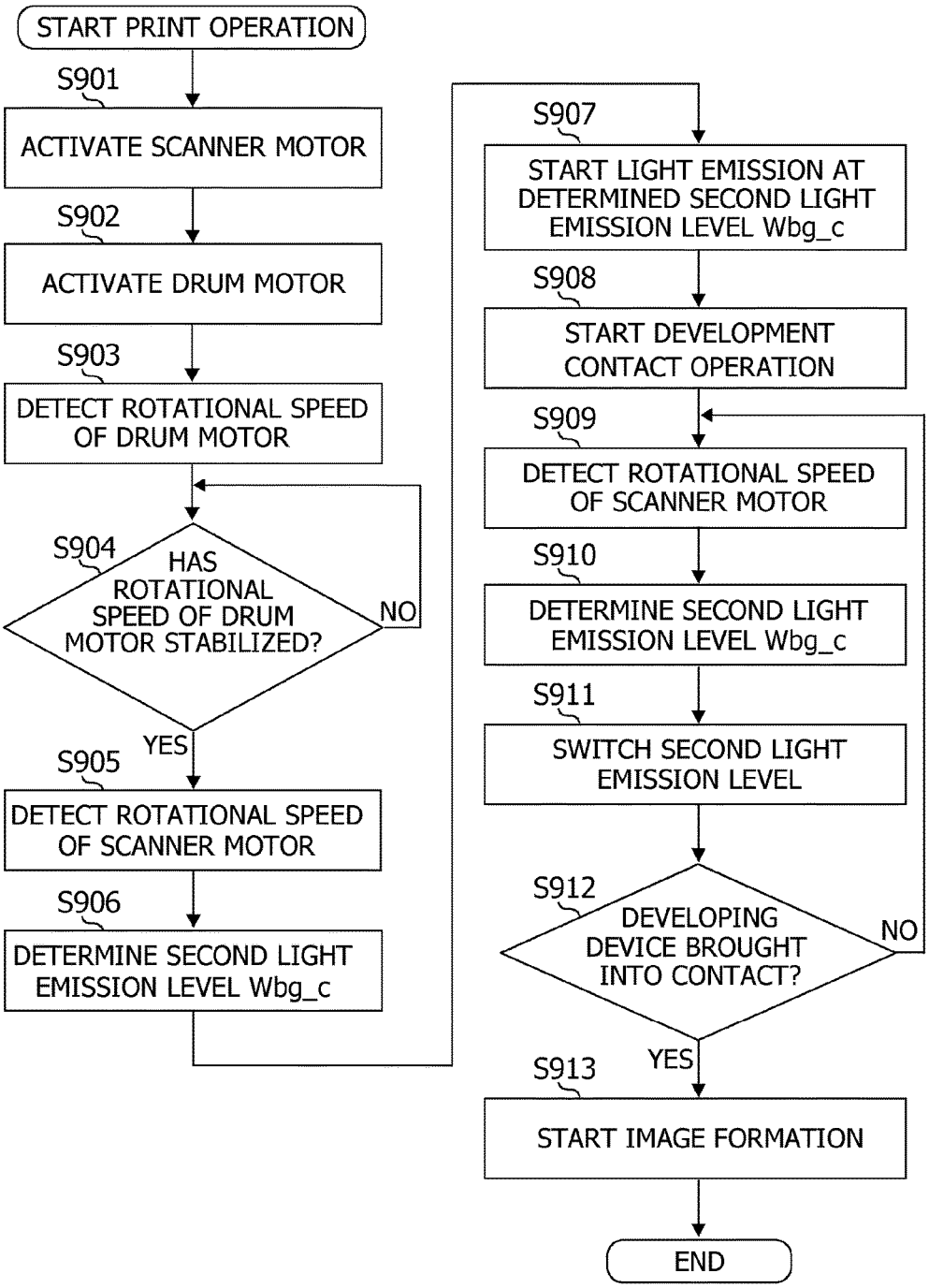
FIG. 17 is a flow chart of a case where a second light emission level is determined in the fourth embodiment.

FIG. 17 is a flow chart of a case where the second light emission level is determined in accordance with a rotational speed of the scanner motor 630 in the present embodiment.

Prior to the image forming operation, the engine controller 422 activates the scanner motor 630 and the drum motor 632 using the scanner motor control unit 610 and the drum motor control unit 615 (S901, S902). The engine controller 422 detects the rotational speed of the drum motor 632 with the drum motor speed detecting unit 617 (S903), and waits for the rotational speed of the drum motor 632 to stabilize (waits for the drum motor 632 to reach the target speed) (S904). At this point, the engine controller 422 sets the second light emission level Wbg_c to 0 and does not perform laser emission until the rotational speed of the drum motor 632 stabilizes.

Once the rotational speed of the drum motor 632 stabilizes (Yes in S904), the rotational speed of the scanner motor 630 is detected by the scanner motor speed detecting unit 614 (S905). In addition, in accordance with the detected rotational speed of the scanner motor 630 and the target speed of the scanner motor 630, the laser light amount calculating unit 612 calculates and determines the second light emission level Wbg_c (S906). The engine controller 422 starts laser emission with respect to the photosensitive drum surface at the determined second light emission level Wbg_c (S907), and starts a development contact operation (S908). Furthermore, the engine controller 422 detects the rotational speed of the scanner motor 630 with the scanner motor speed detecting unit 614 (S909). In addition, in accordance with the detected rotational speed of the scanner motor 630, the laser light amount calculating unit 612 calculates and determines the second light emission level Wbg_c (S910). Subsequently, the engine controller 422 continues laser emission by switching to the determined second light emission level Wbg_c (S911). The engine controller 422 repeats the series of control of S909 to S911 until the engine controller 422 determines that the development contact operation is completed (S912), and once the scanner motor 630 starts up and the development contact operation is completed (Yes in S912), the engine controller 422 starts image formation (S913).

As described above, in the present embodiment, when the rotational speed of the drum motor 632 stabilizes, the second light emission level is determined in accordance with a speed ratio between the target speed and the rotational speed of the scanner motor 630. Accordingly, even during start-up of the scanner motor 630, the potential of the photosensitive drum surface can be placed in a state where toner fogging does not occur.

In addition, in a configuration in which the photosensitive drum 301 and the developing device 304 can be brought into contact with and separated from each other as in the present embodiment, the start timing of a development contact operation can be set earlier. Therefore, a timing at which image formation is started can also be set earlier and a first print-out time can be shortened.

In the present embodiment, a mode having a contact/separation mechanism which enables the photosensitive drum 301 and the developing device 304 to be brought into contact with and separated from each other has been described. The present invention is not limited to this mode, and the present invention can also be preferably applied to a mode which does not have a contact/separation mechanism and in which the photosensitive drum 301 and the developing device 304 are always in a contact state. In a conventional mode in which the photosensitive drum 301 and the developing device 304 are always in a contact state, since the second light emission level is to be set to Wbg from the start of start-up of the motors, there is a concern that fogging toner may be generated before the drum motor and the scanner motor start up. In contrast, when the present invention is applied to a configuration in which the photosensitive drum 301 and the developing device 304 are always in a contact state, the second light emission level is to be set to Wbg at the start of start-up of the motors in a similar manner to a conventional mode. However, once the drum motor starts up, as illustrated in (B) of FIG. 16, light can be emitted at the second light emission level in accordance with the rotational speed of the scanner motor. Therefore, even in a mode of applying the present invention to a configuration in which the photosensitive drum 301 and the developing device 304 are always in a contact state, an occurrence of fogging toner can be suppressed as compared to a conventional mode in which the second light emission level is set to Wbg from the start of start-up of the motors.

Fifth Embodiment

Hereinafter, a fifth embodiment will be described.

In the fourth embodiment, a case in which the rotational speed of the scanner motor 630 during start-up of the scanner motor 630 is taken into consideration has been described. However, in the fourth embodiment, since the rotational speed of the drum motor 632 during start-up of the drum motor 632 is not taken into consideration, it may be preferable to wait for the rotational speed of the drum motor 632 to stabilize at the target speed.

In consideration thereof, in the present embodiment, an operation for determining the second light emission level Wbg in accordance with the rotational speed of the scanner motor 630 during the start-up of the scanner motor 630 and the rotational speed of the drum motor 632 during the start-up of the drum motor 632 will be described. Note that, in the present embodiment, configurations and processes that differ from those of the fourth embodiment will be described and descriptions of configurations and processes that are similar to those of the fourth embodiment will be omitted.

Description of Determination Method of Second Light Emission Level

An exposure amount Ebg_c per unit area of the surface of the photosensitive drum 301 rotating at a speed Vy_c when, with respect to the surface of the photosensitive drum 301, the scanner unit 331 rotates at a scanning speed Vx_c and exposes the surface for a time T at the second light emission level Wbg_c can be calculated as expression 8 below.

$$Ebg_c=(T\times Wbg_c)/((T\times Vx_c)\times(T\times Vy_c)) \quad \text{Expression 8}$$

Even during the start-up of the scanner motor 630 and the drum motor 632, the second light emission level Wbg for keeping the exposure amount Ebg of the photosensitive drum surface constant can be calculated as expressed by expression 9. Therefore, expression 9 indicates that the exposure amount can be set equal by determining the second light emission level in accordance with a speed ratio between the target speed and the rotational speed during start-up of the scanner motor 630 and a speed ratio between the target speed and the rotational speed during start-up of the drum motor 632. In this case, the engine controller 422 stores expression 9 or a correspondence relationship between the rotational speed of the drum motor 632 and the scanning speed of the scanner unit 331, and the second light emission level, as obtained from expression 9.

$$Ebg_c=Ebg$$

$$(T\times Wbg_c)/((T\times Vx_c)\times(T\times Vy_c))=(T\times Wbg)/((T\times Vx)\times(T\times Vy))$$

$$Wbg_c=Wbg\times(Vx_c/Vx)\times(Vy_c/Vy) \quad \text{Expression 9}$$

Description of Timing Chart

Figure 18:
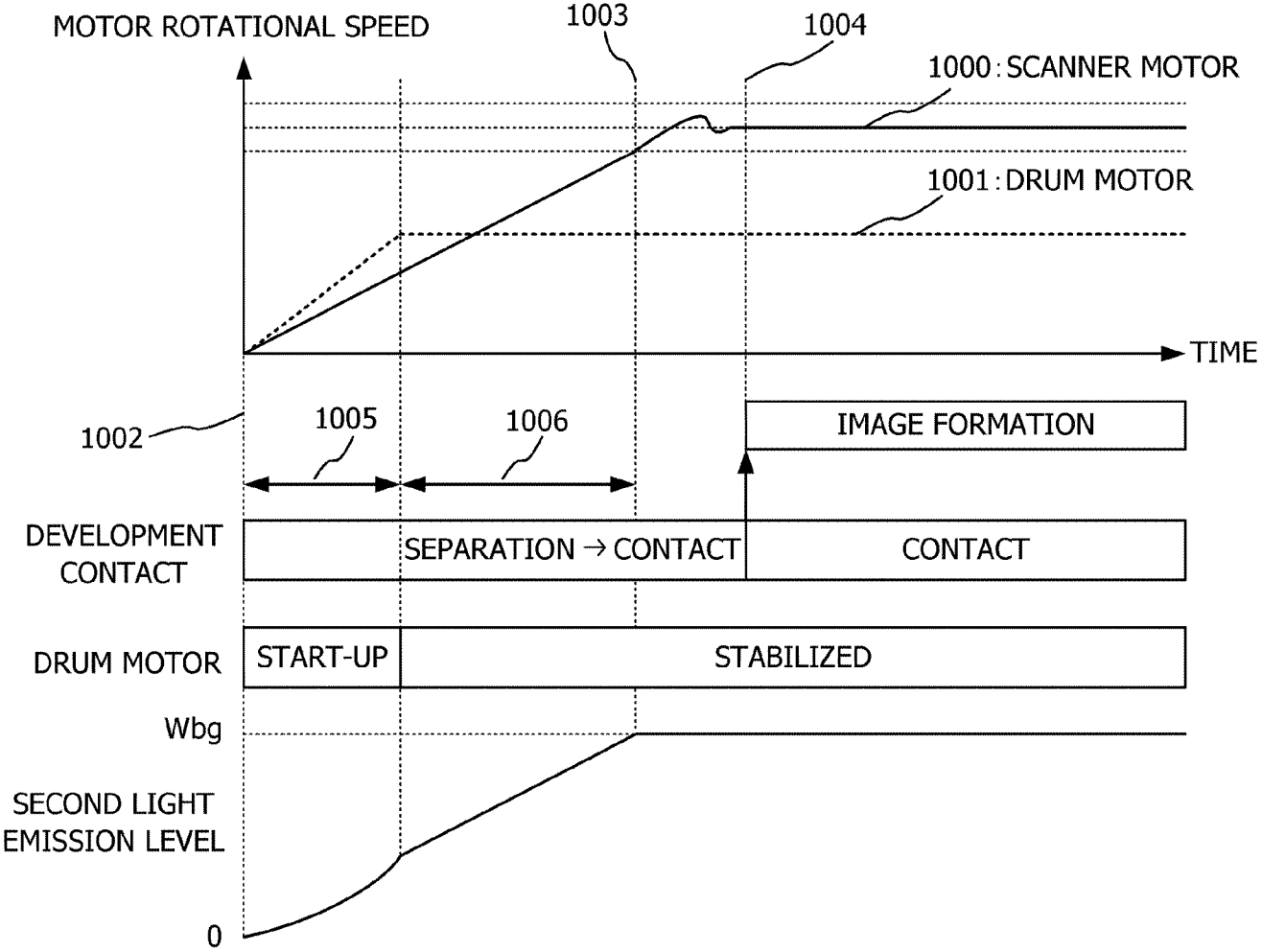
FIG. 18 is a diagram illustrating an example of a preprocessing sequence of an image forming operation according to a fifth embodiment.

FIG. 18 is a diagram illustrating an example of a preprocessing sequence of an image forming operation according to the present embodiment.

A solid line 1000 indicates the rotational speed of the scanner motor 630 and a dashed line 1001 indicates the rotational speed of the drum motor 632. Prior to the start of the image forming operation, the engine controller 422 activates the drum motor 632 and the scanner motor 630 and determines the second light emission level from the rotational speed of the scanner motor 630 and the rotational speed of the drum motor 632. Subsequently, laser emission is started at the determined second light emission level and, at the same time, a development contact operation is started (1002). In the start-up period (a section denoted by reference numeral 1005) of the scanner motor 630 and the drum motor 632, the engine controller 422 switches to the second light emission level in accordance with the rotational speeds of the scanner motor 630 and the drum motor 632 based on expression 9. In a period (a section denoted by reference numeral 1006) in which the rotational speed of the drum motor 632 has reached the target speed and has stabilized and, at the same time, the scanner motor 630 is being started up, the engine controller 422 switches to the second light emission level (the second light emission level described in the fourth embodiment) in accordance with the rotational speed of the scanner motor 630. When the rotational speed of the scanner motor 630 reaches within a certain range of the target speed (1003), the second light emission level becomes Wbg. The engine controller 422 starts image formation once the development contact operation is completed and the photosensitive drum 301 and the developing device 304 are in the contact state (1004).

As described above, in the present embodiment, the second light emission level is determined in accordance with the rotational speed of the scanner motor 630 and the rotational speed of the drum motor 632.

Accordingly, there is no more waiting for the drum motor 632 to reach the target speed and, compared to the method described in the fourth embodiment, a start timing of the development contact operation can be set earlier by an amount denoted by reference numeral 1005 in FIG. 18. As a result, a timing at which image formation is started can also be set earlier and a first print-out time can be shortened.

Description of Flow Chart

Figure 19:
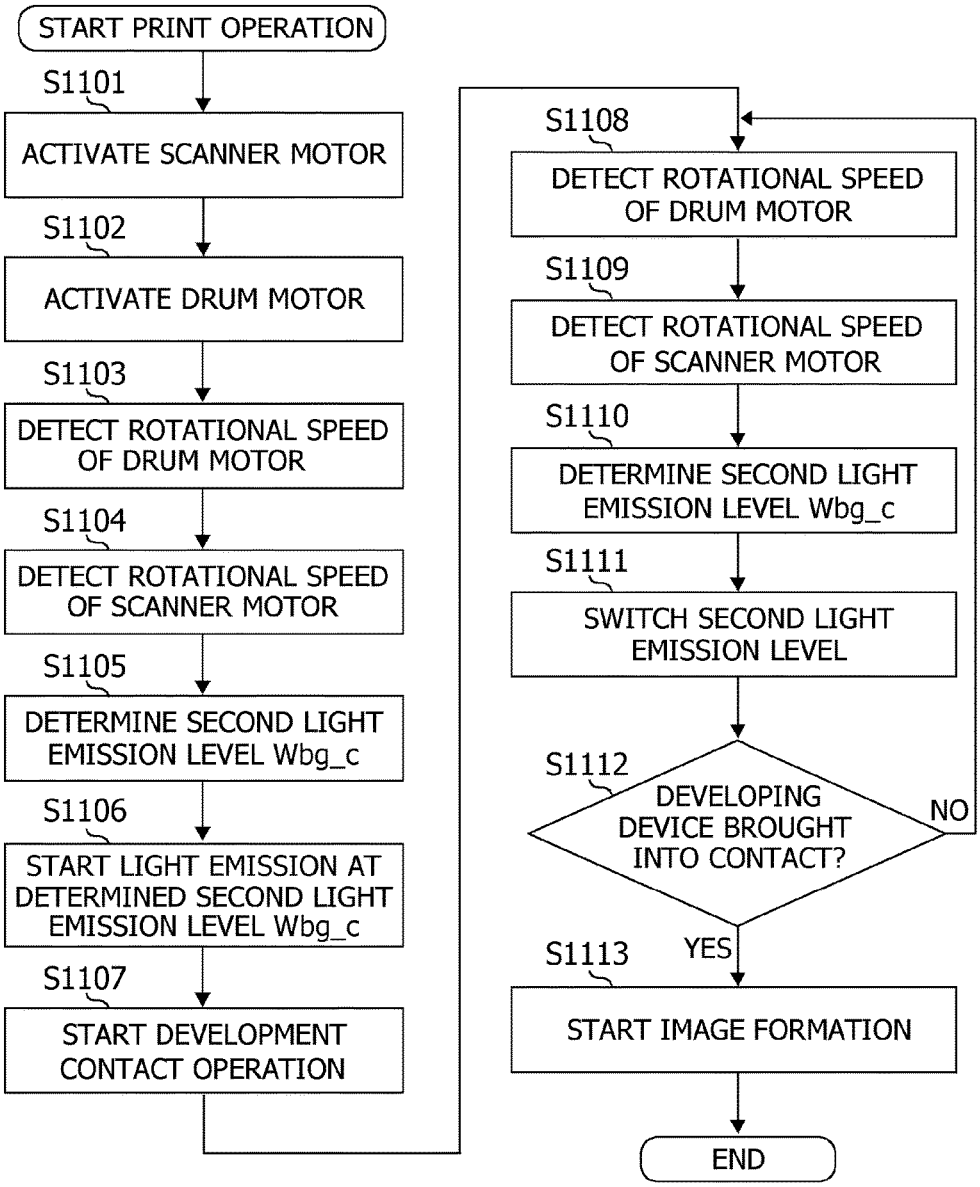
FIG. 19 is a flow chart of a case where a second light emission level is determined in the fifth embodiment.

FIG. 19 is a flow chart of a case where the second light emission level is determined in accordance with a rotational speed of the scanner motor 630 and a rotational speed of the drum motor 632 according to the present embodiment.

Prior to the image forming operation, the engine controller 422 activates the scanner motor 630 and the drum motor 632 using the scanner motor control unit 610 and the drum motor control unit 615 (S1101, S1102). The engine controller 422 detects the rotational speed of the drum motor 632 with the drum motor speed detecting unit 617 (S1103), and detects the rotational speed of the scanner motor 630 with the scanner motor speed detecting unit 614 (S1104). Next, in accordance with the detected rotational speed of the drum motor 632 and the detected rotational speed of the scanner motor 630, the laser light amount calculating unit 612 calculates and determines the second light emission level Wbg_c (S1105). The engine controller 422 starts laser emission at the determined second light emission level Wbg_c (S1106), and starts a development contact operation (S1107).

Furthermore, the engine controller 422 detects the rotational speed of the drum motor 632 with the drum motor speed detecting unit 617 (S1108), and detects the rotational speed of the scanner motor 630 with the scanner motor speed detecting unit 614 (S1109).

Next, the second light emission level Wbg_c is determined in accordance with the rotational speed of the drum motor 632 detected by the drum motor speed detecting unit 617 and the rotational speed of the scanner motor 630 detected by the scanner motor speed detecting unit 614 (S1110), and a switch is made to the determined second light emission level Wbg_c (S1111). The engine controller 422 repeats the control of S1108 to S1111 until the development contact operation is completed (S1112), and once the development contact operation is completed (Yes in S1112), the engine controller 422 starts image formation (S1113).

As described above, in the present embodiment, the second light emission level is determined in accordance with a speed ratio between the target speed and the rotational speed of the scanner motor 630 and a speed ratio between the target speed and the rotational speed of the drum motor 632. Accordingly, even during start-up of the scanner motor 630 and the drum motor 632, the potential of the photosensitive drum surface can be placed in a state where toner fogging does not occur.

In addition, in a configuration in which the photosensitive drum 301 and the developing device 304 can be brought into contact with and separated from each other as in the present embodiment, a development contact operation can be started at the start of motor start-up. Therefore, a timing at which image formation is started can be set earlier and a first print-out time can be shortened.

A mode having a contact/separation mechanism which enables the photosensitive drum 301 and the developing device 304 to be brought into contact with and separated from each other has also been described in the present embodiment. The present invention is not limited to this mode, and the present invention can also be preferably applied to a mode which does not have a contact/separation mechanism and in which the photosensitive drum 301 and the developing device 304 are always in a contact state. Even in such a mode, laser emission at an optimum second light emission level can be realized from the start of start-up of a motor. Therefore, when the photosensitive drum 301 and the developing device 304 are always in a contact state, the potential of the photosensitive drum surface can be placed in a state where toner fogging does not occur during start-up of a motor more effectively in the present embodiment than in the fourth embodiment.

When the scanner motor 630 and the drum motor 632 are activated prior to an image forming operation, start-up periods of the scanner motor 630 and the drum motor 632 differ depending on a state of the image forming apparatus, specifications of the image forming apparatus, and the like.

While a case where the drum motor 632 is started up first and the scanner motor 630 is subsequently started up has been described in the present embodiment, a start-up sequence is not limited thereto and the drum motor 632 may start up after the scanner motor 630 starts up. Even in such a case, by following the flow chart illustrated in FIG. 19, a second light emission level in accordance with the rotational speed of the scanner motor 630 and the rotational speed of the drum motor 632 can be determined.

In addition, an image forming operation may sometimes be performed immediately after a previous image forming operation is stopped. In such a case, when the scanner motor 630 and the drum motor 632 are activated prior to the image forming operation, one of the scanner motor 630 and the drum motor 632 may start up immediately. When the rotational speed of one of two motors is at the target speed immediately after activating the two motors, the second light emission level may be determined in accordance with the rotational speed of the other motor as is the case with the second light emission level described in the fourth embodiment.

Sixth Embodiment

Hereinafter, a sixth embodiment will be described.

In the fourth and fifth embodiments, a method of determining the second light emission level in accordance with the rotational speed of the scanner motor 630 has been described. However, since a time constant of the PWM smoothing circuit 450 is not taken into consideration in these embodiments, when the time constant is large, a time difference between when the second light emission level is switched and when a light emission amount of the laser diode 407 is actually switched increases. In such a case, since the rotational speed of the scanner motor 630 being started up also changes by the time the light emission amount of the laser diode 407 is switched, an exposure amount on the surface of the photosensitive drum 301 decreases and the likelihood of an occurrence of toner fogging increases.

In consideration thereof, a feature of the present embodiment is that a predicting portion which predicts a speed of the scanner motor 630 is provided and that the second light emission level Wbg is determined in accordance with a speed prediction result of the scanner motor 630 and the rotational speed of the drum motor 632. In this case, the predicting portion predicts the rotational speed of the scanner motor 630 when it is supposed that light emitted at the second light emission level determined using the rotational speed of the scanner motor 630 detected by the scanner motor speed detecting unit 614 is irradiated on the surface of the photosensitive drum 301. Subsequently, a second light emission amount is determined in a similar manner to the embodiments described above using the rotational speed of the scanner motor 630 predicted by the predicting portion instead of the rotational speed of the scanner motor 630 detected by the scanner motor speed detecting unit 614. Note that, in the present embodiment, configurations and processes that differ from those of the fourth and fifth embodiments will be described and descriptions of configurations and processes that are similar to those of the fourth and fifth embodiments will be omitted.

Description of Functional Block Diagram

Figure 20:
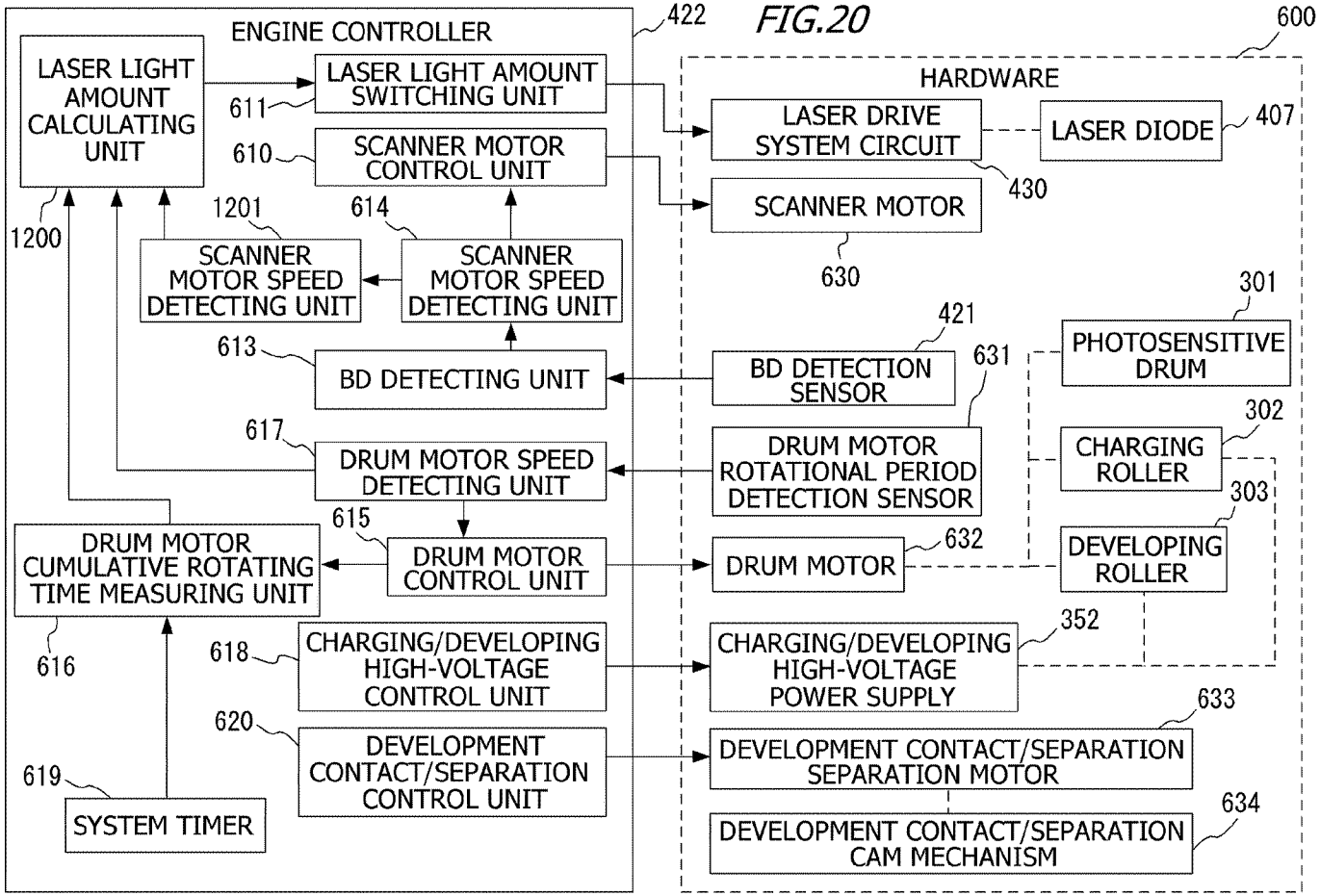
FIG. 20 is a diagram illustrating functional blocks and hardware related to an engine controller.

FIG. 20 is a diagram illustrating functional blocks and hardware 600 related to the engine controller 422.

The engine controller 422 includes a laser light amount calculating unit 1200 instead of the laser light amount calculating unit 612 according to the fourth and fifth embodiments, and newly includes a scanner motor speed predicting unit 1201. The scanner motor speed predicting unit 1201 calculates a predicted speed of the scanner motor 630 from the rotational speed of the scanner motor 630 detected by the scanner motor speed detecting unit 614. The laser light amount calculating unit 1200 calculates a laser light amount based on the predicted speed of the scanner motor 630 calculated by the scanner motor speed predicting unit 1201, a cumulative rotating time of the drum motor 632, and the rotational speed of the drum motor 632. In this case, the cumulative rotating time of the drum motor 632 is measured by the drum motor cumulative rotating time measuring unit 616. Furthermore, the rotational speed of the drum motor 632 is detected by the drum motor speed detecting unit 617.

Description of Flow Chart

Figure 21:
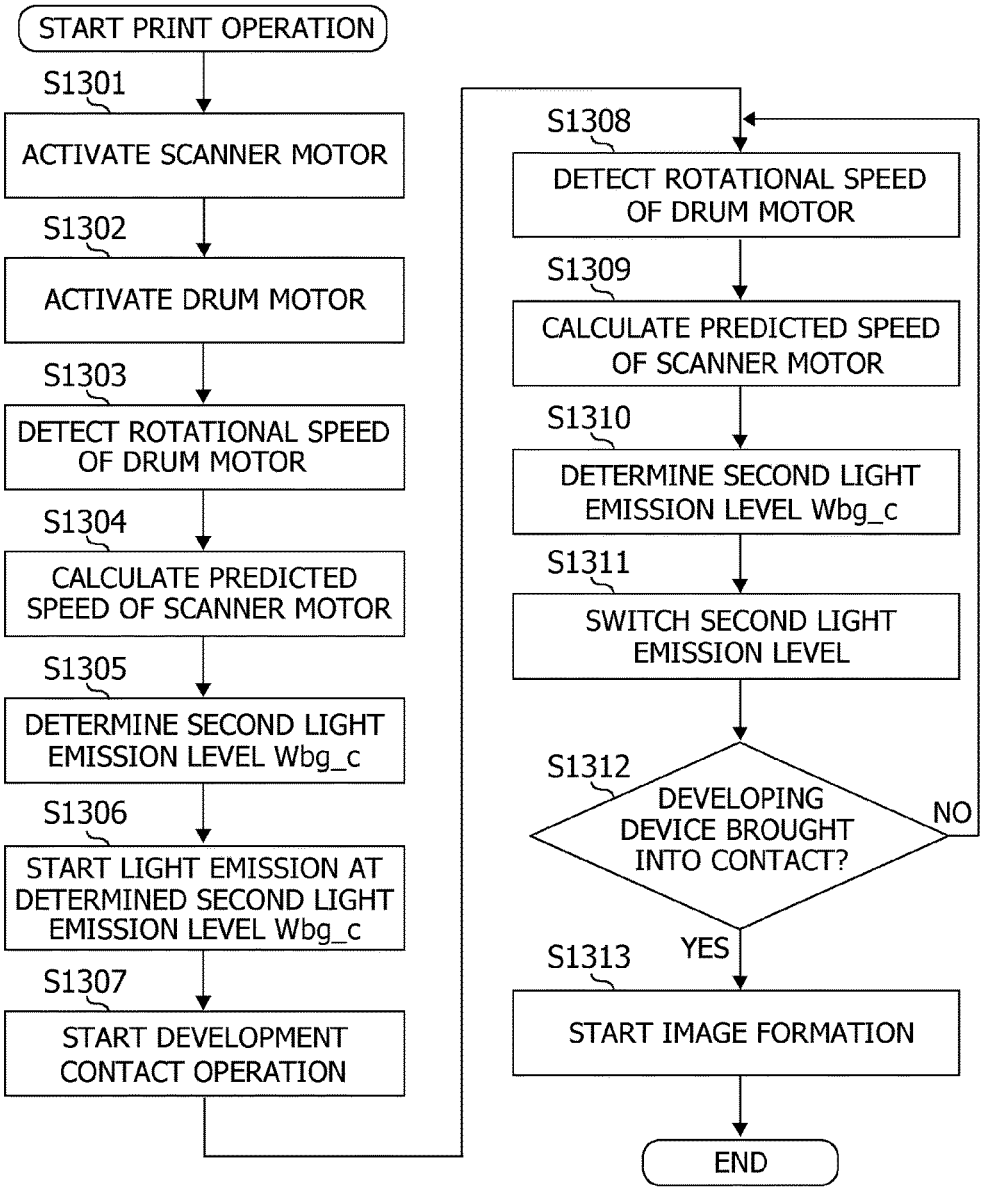
FIG. 21 is a flow chart of a case where a second light emission level is determined in a sixth embodiment.

FIG. 21 is a flow chart of a case where the second light emission level is determined in accordance with a predicted speed of the scanner motor 630 and a rotational speed of the drum motor 632 according to the present embodiment.

Prior to the image forming operation, the engine controller 422 activates the scanner motor 630 and the drum motor 632 using the scanner motor control unit 610 and the drum motor control unit 615 (S1301, S1302). The engine controller 422 detects the rotational speed of the drum motor 632 with the drum motor speed detecting unit 617 (S1303), and calculates the predicted speed of the scanner motor 630 with the scanner motor speed predicting unit 1201 (S1304). Next, in accordance with the rotational speed of the drum motor 632 detected by the drum motor speed detecting unit 617 and the predicted speed of the scanner motor 630 calculated by the scanner motor speed predicting unit 1201, the laser light amount calculating unit 1200 calculates and determines the second light emission level (S1305). At this point, the second light emission level is favorably determined by also taking the cumulative rotating time of the photosensitive drum 301 into consideration in a similar manner to the fourth embodiment. The engine controller 422 starts laser emission at the determined second light emission level Wbg_c (S1306), and starts a development contact operation (S1307).

Furthermore, the engine controller 422 detects the rotational speed of the drum motor 632 with the drum motor speed detecting unit 617 (S1308), and calculates the predicted speed of the scanner motor 630 with the scanner motor speed predicting unit 1201 (S1309). Next, in accordance with the rotational speed of the drum motor 632 detected by the drum motor speed detecting unit 617 and the predicted speed of the scanner motor 630 calculated by the scanner motor speed predicting unit 1201, the laser light amount calculating unit 1200 calculates and determines the second light emission level (S1310). The engine controller 422 switches to the determined second light emission level Wbg_c (S1311). The engine controller 422 repeats the control of S1308 to S1311 until the development contact operation is completed (S1312), and once the development contact operation is completed (Yes in S1312), the engine controller 422 starts image formation (S1313).

As described above, in the present embodiment, the second light emission level is determined in accordance with a speed prediction result instead of a detection result of the rotational speed of the scanner motor 630. Accordingly, even when the time constant of the PWM smoothing circuit 450 is large, the potential of the photosensitive drum surface can be placed in a state where toner fogging does not occur.

While an operation using only a speed prediction result of the scanner motor 630 has been described in the present embodiment, the present embodiment is not limited thereto and, alternatively, a prediction result of the rotational speed of the drum motor 632 may be used. In other words, a prediction result of the rotational speed of the scanner motor 630 and/or the rotational speed of the drum motor 632 may be used to determine the second light amount.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-227859, filed on Nov. 28, 2017, and Japanese Patent Application No. 2017-227967, filed on Nov. 28, 2017, which are hereby incorporated by reference herein in their entirety.

What is claimed is:

1. An image forming apparatus, comprising:

a photosensitive member;

a developing portion configured to switch between a contact state where the developing portion comes into contact with the photosensitive member and a separation state where the developing portion separates from the photosensitive member, and develop a toner image on the photosensitive member in the contact state;

an irradiating portion configured to irradiate light;

a rotating polygon mirror configured to reflect light irradiated from the irradiating portion and scan an image region and a non-image region on the photosensitive member;

a detecting portion configured to detect light reflected by the rotating polygon mirror; and a control portion configured to control so that light is irradiated from the irradiating portion in a first light emission amount for forming an electrostatic latent image in an image portion and in a second light emission amount for controlling a potential of a non-image portion, the second light emission amount being smaller than the first light emission amount, wherein the control portion controls so that:

when the photosensitive member and the developing portion are in the separation state, and in a start-up period in which a rotational speed of the rotating polygon mirror is controlled such that the rotating polygon mirror rotates at a prescribed rotational speed, a first light emission is performed in which the irradiating portion is caused to scan the image region and the non-image region;

when light is detected at least twice by the detecting portion during a first period when the first light emission is being performed, a second light emission is performed in which the irradiating portion is caused to scan the non-image region;

when a prescribed period of time has elapsed from the start of the second light emission, a third light emission is performed in which the image region is scanned in a third light emission amount that is smaller than the second light emission amount during a second period in which the photosensitive member makes at least one revolution; and after the third light emission is performed, the photosensitive member and the developing portion are switched to the contact state.

2. The image forming apparatus according to claim 1, wherein the control portion causes the irradiating portion to scan the non-image region and also causes the detecting portion to perform an operation of detecting light in a third period in which the third light emission is performed.

3. The image forming apparatus according to claim 1, wherein the control portion controls so as to switch the photosensitive member and the developing portion to the contact state after the third light emission is performed and before the rotating polygon mirror rotates at the prescribed rotational speed.

4. The image forming apparatus according to claim 1, wherein the detecting portion outputs a plurality of horizontal synchronization signals to the control portion upon detecting the light, and the control portion determines a fourth period from the plurality of horizontal synchronization signals output from the detecting portion, determines a light emission period in which the second light emission is to be performed based on the fourth period, and further determines a light emission period in which the third light emission is to be performed based on the fourth period.

5. The image forming apparatus according to claim 4, further comprising:

a storage portion which stores the fourth period, wherein when the control portion determines the fourth period from the plurality of horizontal synchronization signals, the control portion updates the fourth period stored in the storage portion.

6. The image forming apparatus according to claim 1, wherein the control portion determines a light emission energy amount based on the rotational speed of the rotating polygon mirror and an amount of light irradiated from the irradiating portion, and determines a timing at which the third light emission is to be performed in accordance with the light emission energy amount.

7. The image forming apparatus according to claim 1, wherein in a light emission period of the third light emission, the control portion changes an amount of light irradiated from the irradiating portion in accordance with the rotational speed of the rotating polygon mirror.

8. The image forming apparatus according to claim 7, wherein the control portion increases the amount of light irradiated from the irradiating portion as the rotational speed of the rotating polygon mirror increases.

9. The image forming apparatus according to claim 1, wherein the control portion performs an adjustment of the first light emission amount or an adjustment of the second light emission amount during a light emission period of the first light emission, or the control portion performs the adjustment of the first light emission amount and/or the adjustment of the second light emission amount during a light emission period of the second light emission.

10. The image forming apparatus according to claim 1, wherein in a light emission period of the second light emission, the control portion causes the irradiating portion to irradiate light only to the non-image region without irradiating light to the image region.

11. An image forming apparatus, comprising:

an image bearing member configured to be rotationally driven;

an irradiating portion which has a rotating polygon mirror that reflects light emitted from a light source toward the image bearing member and configured to irradiate light from the light source to the image bearing member to form a latent image;

a control portion configured to control so as to cause light from the light source to be irradiated to the image bearing member in a first light emission amount for forming the latent image in an image portion and in a second light emission amount for controlling a potential of a non-image portion, the second light emission amount being smaller than the first light emission amount; and an acquiring portion configured to acquire information related to a rotational speed of the rotating polygon mirror and a rotational speed of the image bearing member, wherein the control portion determines the second light emission amount that is emitted from the light source in a start-up period of the rotating polygon mirror performed prior to image formation, based on a correspondence relationship between information related to the rotational speed of the rotating polygon mirror and the rotational speed of the image bearing member acquired by the acquiring portion, and the second light emission amount.

12. The image forming apparatus according to claim 11, wherein during a period until the rotational speed of the image bearing member reaches a target rotational speed, the control portion determines the second light emission amount based on the correspondence relationship between the information related to the rotational speed of the rotating polygon mirror and the rotational speed of the image bearing member, and the second light emission amount, and during a period in which the rotational speed of the image bearing member has reached the target rotational speed, the control portion determines the second light emission amount based on a correspondence relationship between the rotational speed of the rotating polygon mirror and the target rotational speed of the image bearing member, and the second light emission amount.

13. The image forming apparatus according to claim 11, wherein during the period until the rotational speed of the image bearing member reaches a target rotational speed, the control portion sets the second light emission amount to 0, and during the period in which the rotational speed of the image bearing member has reached the target rotational speed, the control portion determines the second light emission amount based on a correspondence relationship between the rotational speed of the rotating polygon mirror and the target rotational speed of the image bearing member, and the second light emission amount.

14. The image forming apparatus according to claim 11, wherein the second light emission amount is larger as the rotational speed of the rotating polygon mirror or the rotational speed of the image bearing member is higher.

15. The image forming apparatus according to claim 11, wherein the correspondence relationship between the information related to the rotational speed of the rotating polygon mirror and the rotational speed of the image bearing member, and the second light emission amount, is defined such that an exposure amount on a surface of the image bearing member when light emitted in the second light emission amount is irradiated is constant.

16. The image forming apparatus according to claim 15, wherein the correspondence relationship is defined using a ratio of the rotational speed of the rotating polygon mirror to a target rotational speed of the rotating polygon mirror and a ratio of the rotational speed of the image bearing member to a target rotational speed of the image bearing member.

17. The image forming apparatus according to claim 11, further comprising:

a developing portion configured so as to be capable of coming into contact with and separating from the image bearing member, and to develop a latent image formed on a surface of the image bearing member when in contact with the image bearing member, wherein the control portion starts an operation for shifting a contact relationship between the image bearing member and the developing portion from a separation state to a contact state when light emission from the light source is started in the second light emission amount during the start-up period.

18. The image forming apparatus according to claim 17, wherein after light emission from the light source is started in the second light emission amount during the start-up period, the control portion repeats a series of operations until the control portion determines that the contact relationship has shifted to the contact state, the series of operations including: causing the acquiring portion to acquire the information related to the rotational speed of the rotating polygon mirror and the rotational speed of the image bearing member; determining the second light emission amount from the acquired information; causing light emission from the light source to be continued by switching to the determined second light emission amount; and determining whether or not the contact relationship has shifted to the contact state.

19. The image forming apparatus according to claim 11, further comprising:

a predicting portion configured to predict a rotational speed of the rotating polygon mirror and a rotational speed of the image bearing member when the image bearing member is irradiated with light emitted in the second light emission amount determined using the information related to the rotational speed of the rotating polygon mirror and the rotational speed of the image bearing member acquired by the acquiring portion, wherein the control portion determines the second light emission amount using the rotational speed of the rotating polygon mirror and the rotational speed of the image bearing member predicted by the predicting portion, instead of the information acquired by the acquiring portion.

20. The image forming apparatus according to claim 11, wherein in the image portion, light in the first light emission amount is irradiated from the light source in order to allow adherence of a developer and the latent image is formed, and in the non-image portion, light in the second light emission amount is irradiated from the light source in order to prevent adherence of the developer.

* * * * *